US011976519B2

(12) United States Patent
Yu et al.

(10) Patent No.: US 11,976,519 B2
(45) Date of Patent: May 7, 2024

(54) RIDGE SHAPED ELEMENT

(71) Applicant: Schlumberger Technology Corporation, Sugar Land, TX (US)

(72) Inventors: Feng Yu, Lindon, UT (US); Cheng Peng, Orem, UT (US); Ronald Eyre, Orem, UT (US); Douglas Marsh, South Jordan, UT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 137 days.

(21) Appl. No.: 17/905,569

(22) PCT Filed: Mar. 1, 2021

(86) PCT No.: PCT/US2021/020274
§ 371 (c)(1),
(2) Date: Sep. 2, 2022

(87) PCT Pub. No.: WO2021/178304
PCT Pub. Date: Sep. 10, 2021

(65) Prior Publication Data

US 2023/0151697 A1 May 18, 2023

Related U.S. Application Data

(60) Provisional application No. 62/983,883, filed on Mar. 2, 2020.

(51) Int. Cl.
*E21B 10/567* (2006.01)

(52) U.S. Cl.
CPC ..... *E21B 10/5673* (2013.01)

(58) Field of Classification Search
CPC ..... E21B 10/5673
See application file for complete search history.

(56) References Cited

U.S. PATENT DOCUMENTS 5,678,645 A * 10/1997 Tibbitts ..... E21B 10/5673 175/429
6,244,365 B1 6/2001 Southland
6,510,910 B2 1/2003 Eyre
(Continued)

FOREIGN PATENT DOCUMENTS

EP 2425950 A1 3/2012
WO 2018231343 A1 12/2018
WO 2019128956 A1 7/2019

OTHER PUBLICATIONS

International Search Report and Written Opinion issued in International Patent application PCT/2021/020274 on Jun. 21, 2021, 8 pages.

*Primary Examiner* — Shane Bomar
(74) *Attorney, Agent, or Firm* — Jeffrey D. Frantz

(57) ABSTRACT

A cutting element includes a substrate and an ultrahard layer on an upper surface of the substrate, a top surface of the ultrahard layer having a ridge extending along a major dimension of the top surface from an edge of the top surface, where the ridge has a peak with at least two different roof radii of curvature, and at least two sidewalls sloping in opposite directions from the peak of the ridge at a roof angle, where a first roof angle of the ridge proximate the edge is smaller than a second roof angle in a central portion of the ridge around a longitudinal axis of the cutting element.

19 Claims, 18 Drawing Sheets

(56) References Cited

U.S. PATENT DOCUMENTS

| | | | | |
|---|---|---|---|---|
| 6,550,556 | B2 | 4/2003 | Middlemiss | |
| 6,604,588 | B2 | 8/2003 | Eyre | |
| 11,365,589 | B2 * | 6/2022 | Cheng | E21B 10/5673 |
| 11,391,095 | B2 * | 7/2022 | Tian | E21B 10/5676 |
| 11,492,852 | B2 * | 11/2022 | Bao | E21B 10/58 |
| 2005/0103532 | A1 | 5/2005 | Magin | |
| 2010/0135741 | A1 * | 6/2010 | Probst | E21B 10/58 408/230 |
| 2018/0274303 | A1 * | 9/2018 | Song | C04B 41/91 |
| 2018/0363384 | A1 * | 12/2018 | Bao | E21B 10/5676 |
| 2019/0084087 | A1 * | 3/2019 | Chapman | B24D 99/005 |
| 2019/0330928 | A1 | 10/2019 | Graham et al. | |
| 2020/0347680 | A1 * | 11/2020 | Tian | E21B 10/5673 |
| 2021/0372203 | A1 * | 12/2021 | Eyre | E21B 10/5735 |

* cited by examiner

RIDGE SHAPED ELEMENT

CROSS REFERENCE TO RELATED APPLICATIONS

This application is the U.S. national phase of International Patent Application No. PCT/US2021/020274, filed Mar. 1, 2021, which claims the benefit of Provisional Application No. 62/983,883 filed on Mar. 2, 2020, which is hereby incorporated by reference in its entirety.

BACKGROUND

Drag bits, often referred to as "fixed cutter drill bits," include bits that have cutting elements attached to the bit body, which may be a steel bit body or a matrix bit body formed from a matrix material such as tungsten carbide surrounded by a binder material. Drag bits may generally be defined as bits that have no moving parts. Drag bits having cutting elements made of an ultrahard cutting surface layer or "table" (generally made of polycrystalline diamond material or polycrystalline boron nitride material) deposited onto or otherwise bonded to a substrate are known in the art as polycrystalline diamond compact ("PDC") bits.

An example of a drag bit having a plurality of cutting elements with ultrahard working surfaces is shown in FIG. 1. The drill bit 10 includes a bit body 11 having a threaded upper pin end 12 and a cutting end 13. The cutting end 13 generally includes a plurality of ribs or blades 14 arranged about the rotational axis (also referred to as the longitudinal or central axis) of the drill bit and extending radially outward from the bit body 11. Cutting elements, or cutters, 15 are embedded in the blades 14 at predetermined angular orientations and radial locations relative to a working surface and with a desired back rake angle and side rake angle against a formation to be drilled.

The cutters 15 are generally cylindrical in shape having an ultrahard material layer attached to a substrate, such as a cemented carbide substrate. The top surface of the ultrahard material layer may be referred to as a working surface, and the edge formed around the top surface may be referred to as the cutting edge, as the working surface and cutting edge of the cutting elements are typically the surfaces that contact and cut a formation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Some embodiments of the present disclosure relate to cutting elements that include a substrate and an ultrahard layer on an upper surface of the substrate, a top surface of the ultrahard layer having a ridge extending along a major dimension of the top surface from an edge of the top surface, where the ridge may have a peak with at least two different roof radii of curvature, and at least two sidewalls sloping in opposite directions from the peak of the ridge at a roof angle, where a first roof angle of the ridge proximate the edge may be smaller than a second roof angle in a central portion of the ridge around a longitudinal axis of the cutting element.

Some embodiments of the present disclosure relate to cutting elements that include a top surface having a ridge extending from an edge of the top surface along a major dimension of the top surface, and a peak of the ridge having a width measured between opposite points of transition from the peak to a sidewall, wherein the width of the peak in a central portion of the ridge around a longitudinal axis of the cutting element may be greater than the width of the peak in the edge portion of the ridge, the edge portion extending a length of the ridge from the edge to the central portion, and wherein the peak may have a roof radius of curvature along an edge portion of the ridge less than 0.1 inches.

Some embodiments disclosed herein relate to cutting elements that include a substrate and an ultrahard layer on an upper surface of the substrate, a top surface of the ultrahard layer having a geometric surface axially extended from a plurality of recessed edge portions formed around an edge of the top surface, and at least one ridge extending radially outward from the geometric surface to the edge of the top surface, the at least one ridge having a peak with a roof radius of curvature.

Some embodiments disclosed herein relate to methods of forming a cutting element that includes providing a cutting element having a ridge formed at a top surface of the cutting element, the ridge extending along a major dimension of the top surface from an edge of the top surface, wherein the ridge has a peak with a first roof radius of curvature and sidewalls sloping away from the peak at a first roof angle, and removing an amount of ultrahard material from the top surface around an edge portion of the ridge to form a second peak having a second roof radius of curvature smaller than the first roof radius of curvature and recessed sidewalls sloping away from the second peak at a second roof angle smaller than the first roof angle, wherein the edge portion having the second roof radius of curvature and the second roof angle extends a partial length of the ridge from the edge toward a longitudinal axis of the cutting element.

Other aspects and advantages will be apparent from the following description and the appended claims.

DETAILED DESCRIPTION

Embodiments of the present disclosure generally relate to shaped elements (e.g., shaped cutting elements), which may be mounted to drill bits for drilling earthen formations or other cutting tools. The shaped element geometry may include a non-planar top surface, also referred to as a working surface or cutting face, formed on an ultrahard layer of the shaped element. Further, the ultrahard layer of the shaped element may be on a substrate at a non-planar interface surface designed to improve the cutting performance of the non-planar top surface. Shaped elements of the present disclosure may be mounted to various types of downhole tools, including but not limited to, drill bits, such as drag bits, reamers, and other downhole milling tools.

Figure 1:
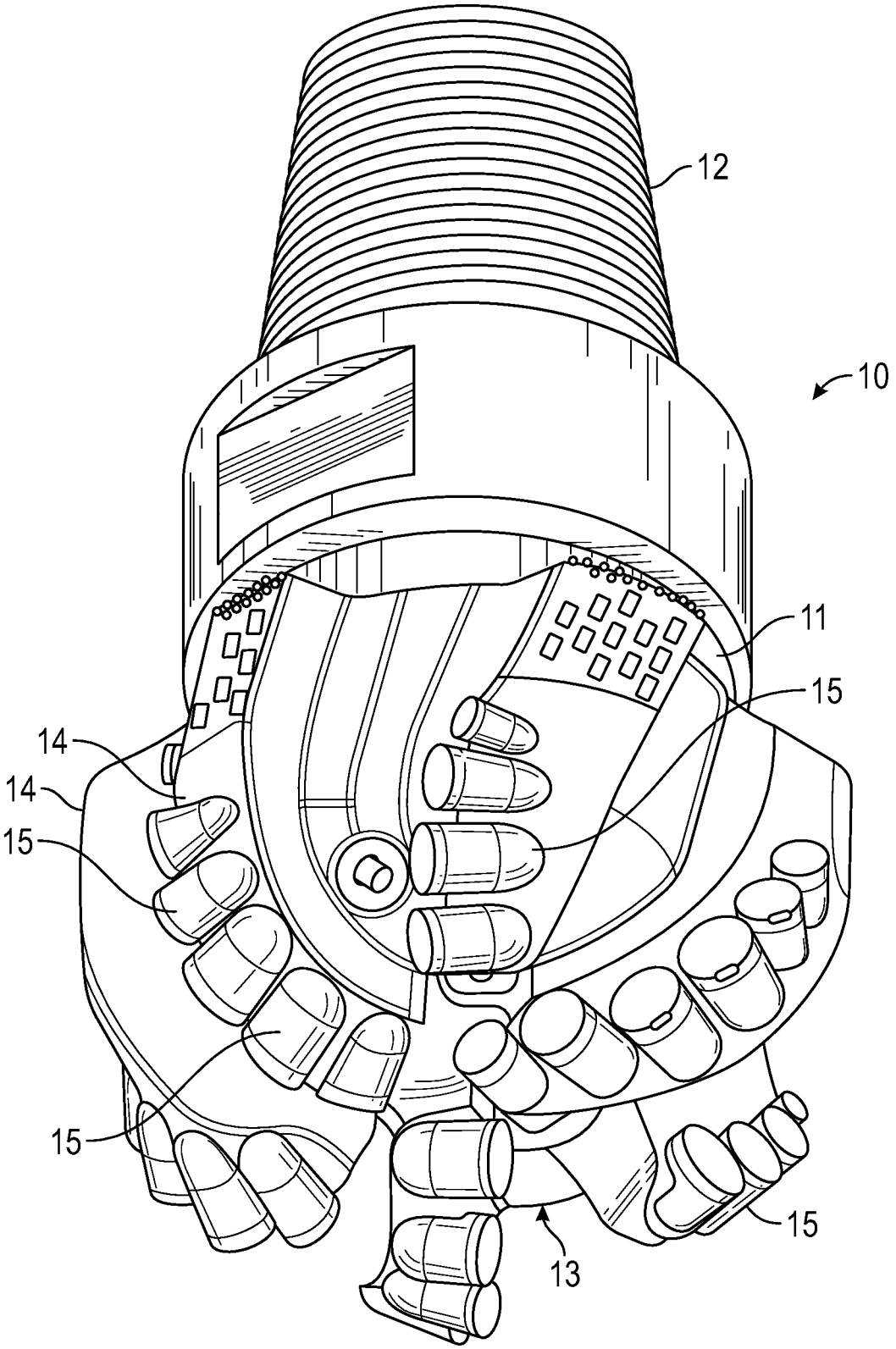
FIG. 1 (Prior Art)
FIG. 1 is a conventional drill bit.
Figure 2:
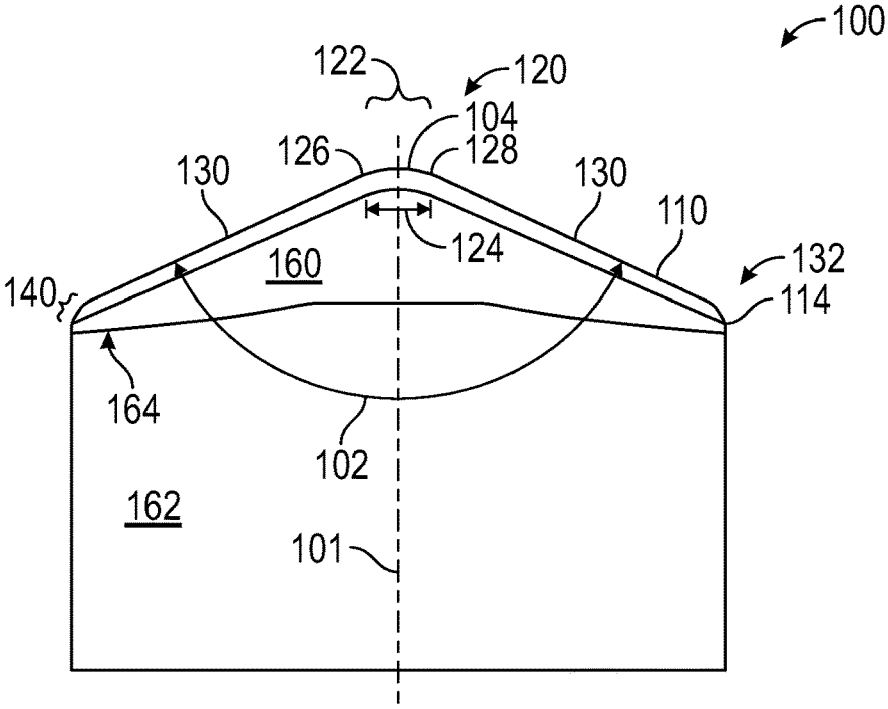
FIGS. 2 and 3 show side views of a cutting element according to embodiments of the present disclosure.
Figure 3:
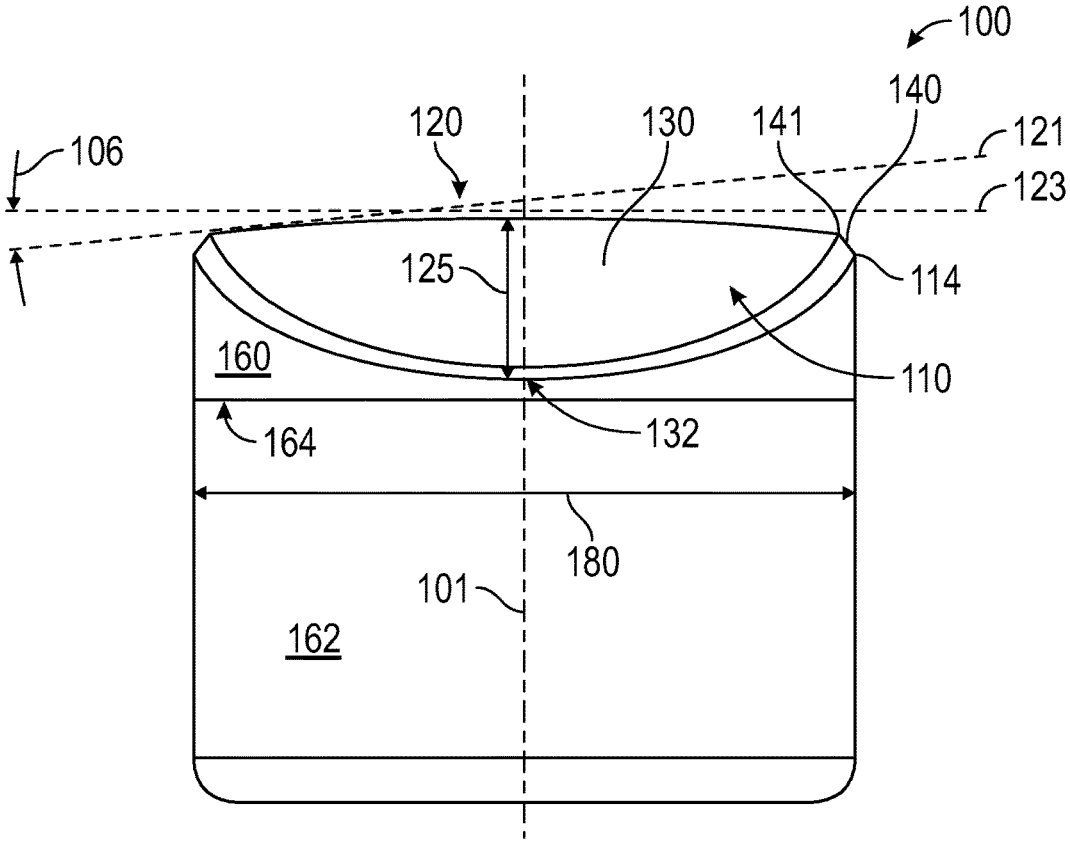

The non-planar top surface may have a ridge geometry optimized to improve drilling efficiency and stability. Three parameters of the ridge geometry—roof angle, roof radius of curvature, and roof ridge angle—have been identified as factors in determining the cutting element engagement with a rock formation and torque resistance in the cutting tool. According to embodiments of the present disclosure, roof angle, roof radius of curvature, and roof ridge angle may be designed in combination to provide improved cutting efficiency. FIGS. 2 and 3 show side views of a cutting element 100 according to embodiments of the present disclosure identifying the roof angle 102, roof radius of curvature 104, and roof ridge angle 106 of the cutting element ridge geometry.

The cutting element 100 includes an ultrahard layer 160 disposed on a substrate 162 at an interface 164, where the non-planar top surface 110 geometry is formed on the ultrahard layer 160. The non-planar top surface 110 geometry includes a ridge 120 extending along a major dimension 180 of the top surface between opposite sides of an edge 114 surrounding (and defining the bounds of) the top surface 110. The presence of the ridge 120 results in an undulating edge 114 having raised and recessed portions relative to each other. In the embodiment shown, the ridge 120 may extend across the entire diameter of the ultrahard layer 160 between two opposite raised portions of the edge 114.

A chamfer 140 may be formed around the edge 114, or periphery, of the top surface 110, where the chamfer 140 extends radially inward from the edge 114 of the top surface 110. In some embodiments, the chamfer 140 may extend around the entire periphery of the top surface 110. In some embodiments, the chamfer 140 may extend partially around the periphery of the top surface 110 (i.e., less than the entire periphery of the top surface 110). In one or more embodiments, the chamfer 140 may vary in angle and/or width around the edge 114. In some embodiments, a cutting element 100 may have a radiused edge 114.

As shown, the ridge 120 has a peak 122 with a convex cross-sectional shape when viewed along a plane perpendicular to the length of the ridge 120 along the major dimension 180, where the peak 122 has a roof radius of curvature 104. The peak 122 of the ridge 120 may have a width 124 measured between opposite points 126, 128 of transition from the peak 122 to a sidewall 130. A roof radius of curvature 104 may be selected from a range of 0.02 inches to 0.2 inches, depending on, for example, the size of the cutting element 100 and the other ridge geometry factors of interest in this disclosure, including the roof angle 102 and roof ridge angle 106. Further, according to embodiments of the present disclosure, a roof radius of curvature 104 may be varied along the length of the ridge 120. For example, as discussed more below, a first portion of the ridge 120 may have a peak 122 with a first roof radius of curvature 104, and a second portion of the ridge 120 may have a peak 122 with a second roof radius of curvature 104 that is greater than the first roof radius of curvature 104.

While the embodiment shown in FIGS. 2 and 3 has a ridge 120 with a convex peak 122, it is also within the scope of the present disclosure that the peak 122 may have a plateau or substantially planar face along a portion of the ridge 120. In such embodiment, the peak 122 may have a substantially infinite roof radius of curvature 104. Further, planar peak 122 portions of a ridge 120 may have radiused transitions to the sidewalls 130 on either side of the ridge 120.

The roof angle 102 is the angle defined between the sidewalls 130 along a longitudinal plane parallel with the longitudinal axis 101 of the cutting element 100 and perpendicular to a plane tangent to each sidewall 130. According to embodiments of the present disclosure, a roof angle 102 may be selected from a range of about 110 degrees to about 165 degrees, depending on, for example, the size of the cutting element 100 and the other ridge geometry factors of interest in this disclosure, including the roof radius of curvature 104 and roof ridge angle 106. Further, according to embodiments of the present disclosure, a roof angle 102 may be varied along the length of the ridge 120. For example, as discussed more below, a first portion of the ridge 120 may have a peak 122 with a first roof angle 102, and a second portion of the ridge 120 may have a peak 122 with a second roof angle 102 that is greater than the first roof radius of curvature 104.

In embodiments having a chamfer 140 formed around the edge 114 of the top surface 110, the peak 122 of the ridge 120 may intersect with an interior boundary 141 of the chamfer 140, where the peak 122 of the ridge 120 may extend from proximate the edge 114 of the cutting element 100 in a direction toward the longitudinal axis 101. In some embodiments, the peak 122 of the ridge 120 may extend from the edge 114 of the cutting element 100 without a chamfer between the edge 114 and the peak 122.

The ridge 120 may be axially separated a height 125 from a recessed edge portion 132 formed around the edge 114 of the top surface 110, where the recessed edge portion 132 may be the axially farthest region of the edge 114 from the peak 122 of the ridge 120. In some embodiments, the height 125 of the ridge 120 may be uniform along its length, where the entire peak 122 extends along a plane 123 perpendicular to the longitudinal axis 101. In some embodiments, such as shown in FIG. 3, the height 125 of the ridge 120 may vary. For example, as shown in FIG. 3, the height 125 of the ridge may increase in a direction from the edge 114 toward the longitudinal axis 101, such that the peak 122 of the ridge 120 has a sloped portion proximate the edge 114 of the top surface 110.

A roof ridge angle 106 is the angle defined between a line 121 tangent to the peak 122 of the ridge 120 proximate the edge 114 and a plane 123 perpendicular to the longitudinal axis 101. According to embodiments of the present disclosure, a ridge 120 may have a roof ridge angle 106 selected from a range of zero to about 10 degrees on one or both edge portions of the ridge 120, such that the axial height of the ridge 120 at the edge portion of the ridge 120 is less the axial height of the ridge 120 at the central portion of the ridge 120.

According to embodiments of the present disclosure, an edge portion of a ridge may have a roof ridge angle greater than zero in combination with a reduced roof radius of curvature and a reduced roof angle when compared with a central portion of the ridge. Such combination of ridge geometry factors may increase cutting efficiency.

For example, as shown in the embodiment of FIGS. 4-7, an ultrahard layer 200 may have an edge portion 221 of a ridge 220 with a roof ridge angle 206 greater than zero in combination with a reduced roof radius of curvature 204*a* and a reduced roof angle 202*a* when compared with a central portion 223 and/or other portions of the ridge 220 along its length 280.

In some embodiments, an edge portion 221 of a ridge 220 may refer to a length 281 of the ridge 220 measured from the edge 214 of the top surface 210 that corresponds with a predicted depth of cut of the cutting element during operation. For example, if a predicted depth of cut of a cutting element during operation ranges up to 0.2 inches, a cutting edge portion 221 of a ridge 220 formed on the top surface 210 of the cutting element may refer to the portion of the ridge within 0.2 inches from the edge 214 of the top surface 214. In some embodiments, an edge portion 221 of a ridge 220 may refer to a percentage of the entire length 280 of the ridge proximate the edge 214 of the top surface 210. For example, an edge portion 221 may extend a length 281 from the edge 214 of the top surface 210 that is between 5 and 30 percent of the entire length 280 of the ridge 220.

FIGS. 4-7 show the ultrahard layer 200 portion of a cutting element, which may be attached to (or formed to) a substrate at a planar or non-planar interface to form the cutting element. For example, in the embodiment shown in FIGS. 4-7, the ultrahard layer 200 may have a bottom surface 207 that may be attached to an upper surface of a substrate having a geometry corresponding to the bottom surface 207 geometry, forming an interface between the ultrahard layer 200 and substrate.

Figure 4:
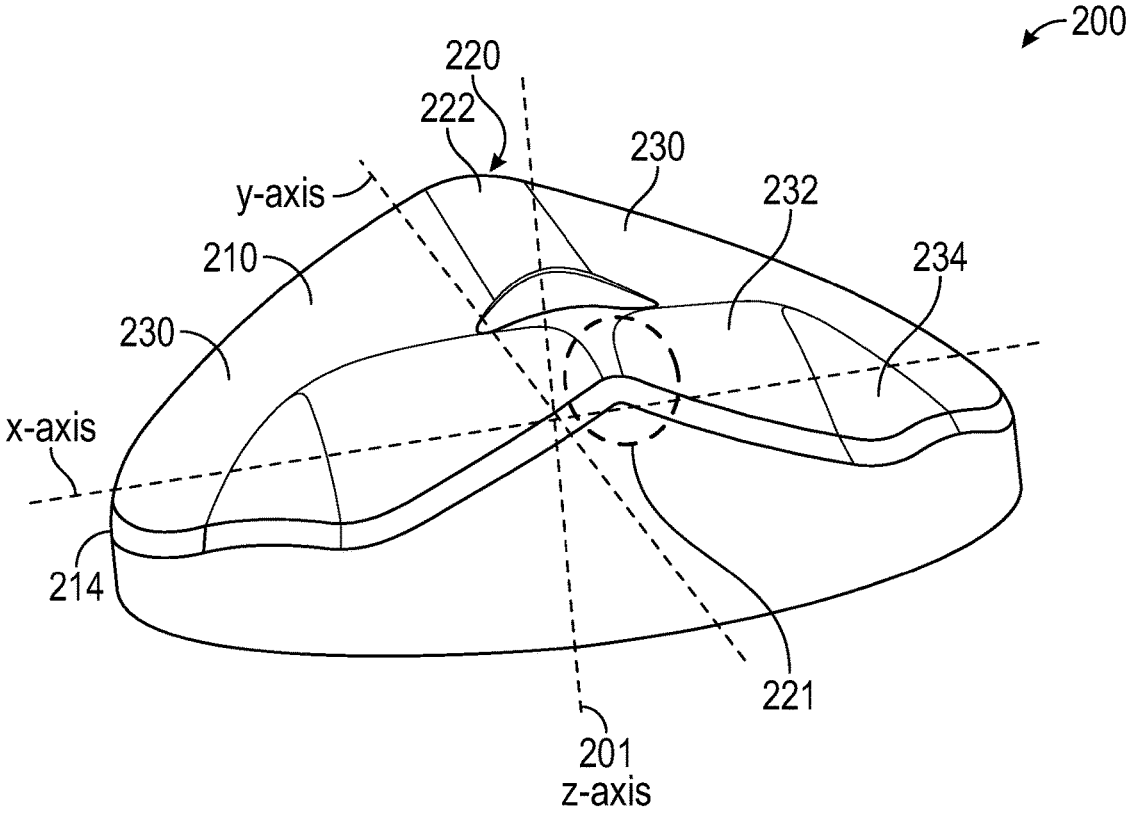
FIG. 4 shows an ultrahard layer according to embodiments of the present disclosure.
Figure 5:
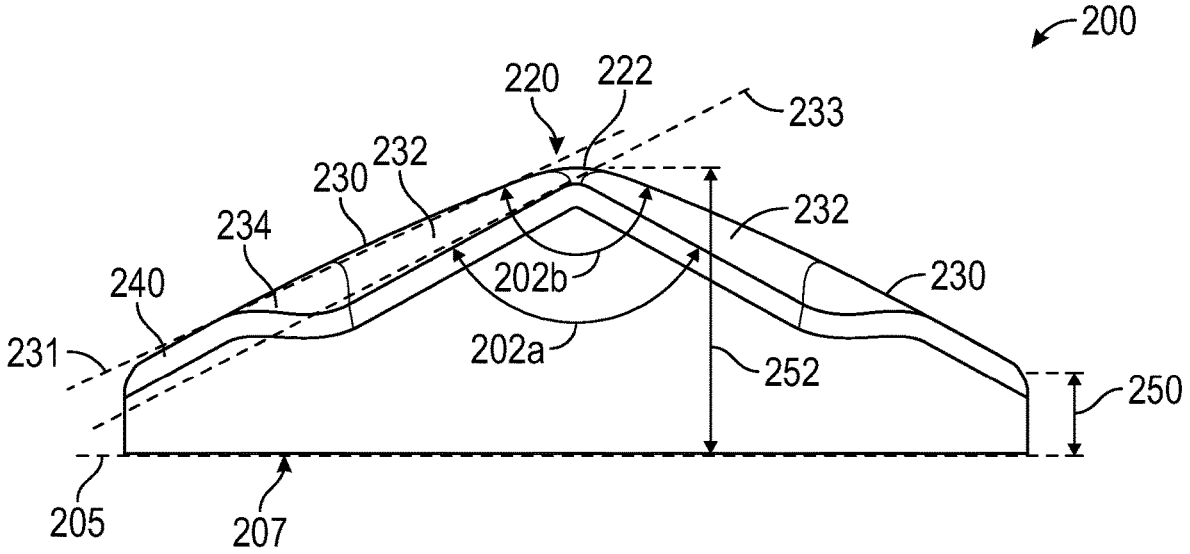
FIG. 5 shows a side view of the ultrahard layer shown in FIG. 4.
Figure 6:
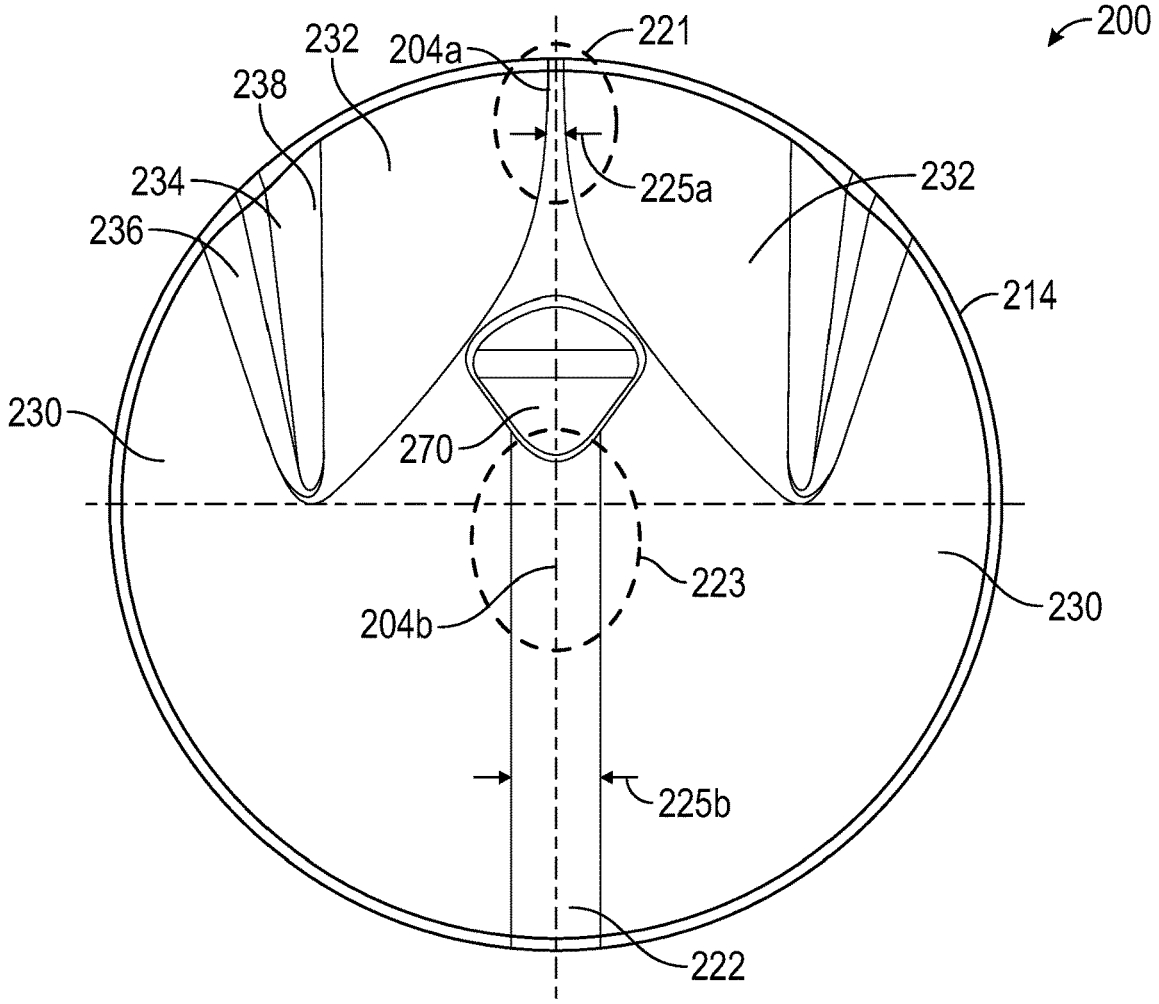
FIG. 6 shows a top view of the ultrahard layer shown in FIGS. 4 and 5.
Figure 7:
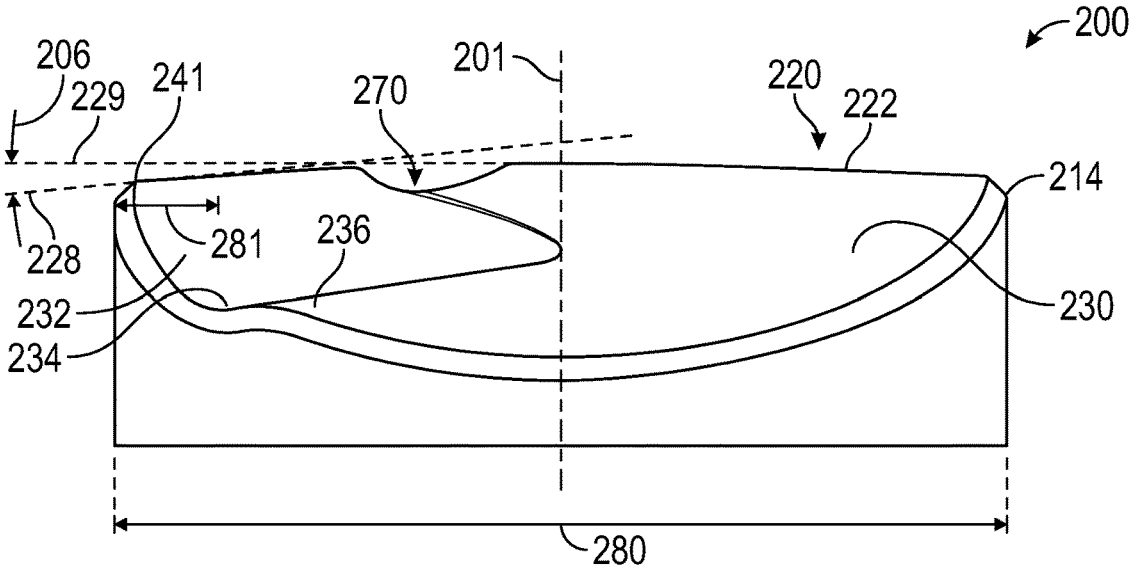
FIG. 7 shows another side view of the ultrahard layer shown in FIGS. 4-6.

The geometry of the top surface 210 of the cutting element 200 may be described with respect to an x-y-z coordinate system, as shown in FIG. 4. The ultrahard layer 200 has a longitudinal axis 201 coinciding with the z-axis extending there through. The non-planar top surface 210 formed on the ultrahard layer 200 has a geometry formed by varying heights 250 along the x-axis and y-axis, wherein the height 250 is measured along the z-axis from a common base plane 205 through a bottom surface 207 of the ultrahard layer 200. As shown in FIG. 5, which is a side view in an x-z coordinate plane of the ultrahard layer 200, the peak 222 of the ridge 220 has the greatest heights 252 formed in the top surface 210. As shown in FIGS. 6 and 7, which show a top view in an x-y coordinate plane and a side view in an y-z coordinate plane, respectively, the ridge 220 extends a length 280 across the diameter of the ultrahard layer 200 along the y-axis between opposite sides of the edge 214 of the top surface 210. From the sake of convenience, the y-axis is consistently defined based on the extension direction of the ridge 220; however, one skilled in the art would appreciate that if defined differently, the remaining description based on the x-, y-, z-coordinate system would similarly vary.

At least two sidewalls 230, 232 slope in opposite directions from the peak 222 of the ridge 220 at a roof angle 202*a*, 202*b* (collectively referred to as 202). First sidewalls 232 extend a length along the y-axis from proximate an edge 214 of the ultrahard layer 200 and slope outwardly from the peak 222 in opposite directions along the x-axis. Second sidewalls 230 may be adjacent to the first sidewalls 232, extending a length along the y-axis from the first sidewalls 232 and sloping outwardly from the peak 222 and from a transition 234 to the first sidewalls 232 in opposite directions along the x-axis. As shown in FIG. 5, the slope of the sidewalls 230, 232 may be measured along a line 231, 233 tangent to the sidewalls 230, 232. In the embodiment shown, the sidewalls 230, 232 are substantially planar faces sloping from the peak 222 of the ridge 220 in a direction toward the edge 214 of the top surface 210. The transition between the sidewalls 230, 232 and the peak 222 may be radiused or angled.

The roof angle 202 may vary along the length of the ridge 220. For example, different portions along the ridge 220 may have different roof angles 202*a*, 202*b*. The roof angle 202 may gradually transition (e.g., through radiused transitions) between different roof angles 202 by differently sloping sidewalls, for example, undulating sidewalls, sloping from the peak 222 of the ridge 220 at different slopes 231, 233. In the embodiment shown, an edge portion 221 of the ridge 220 proximate the edge 214 may have first sidewalls 232 extending from the peak 222 of the ridge 220 at a first roof angle 202*a*, and a central portion 223 of the ridge 220 around the longitudinal axis 201 may have second sidewalls 230 extending from the peak 222 of the ridge 220 at a second roof angle 202*b*, where the first roof angle 202*a* is smaller than the second roof angle 202*b*.

The first sidewalls 232 sloping from the ridge 220 at the first roof angle 202*a* may be recessed from the second sidewalls 230 sloping from the ridge 220 at the second roof angle 202*b*, where the first sidewalls 232 may have a lesser height 250 than the second sidewalls 230 along the y-dimension at a shared x-position. The first sidewalls 232 may transition to the second sidewalls 230 through a gradual transition proximate the peak 222, where the first sidewalls 232 have a relatively steeper slope 233 proximate the edge portion 221 of the ridge 220 that gets shallower in the direction from the edge portion 221 toward the central portion 223 until the first sidewalls 232 transitions to the second sidewalls 232. The first sidewalls 232 may also transition to the second sidewalls 230 via one or more transition surfaces, such as landing 234 and radiused transitions 236, 238 between planar portions of the sidewalls 230, 232.

The peak 222 may further have a varying roof radius of curvature 204*a*, 204*b* (collectively referred to as 204) corresponding to changes in the roof angle 202. For example, in the embodiments shown, the edge portion 221 of the ridge 220 may have a first roof radius of curvature 204*a*, where first sidewalls 232 extend at the first roof angle 202*a* from the peak 222, and the central portion 223 of the ridge 220 may have a second roof radius of curvature 204*b*, where the second sidewalls 230 extend at the second roof angle 202*b* from the peak. Both the first roof radius of curvature 204*a* and the first roof angle 202*a* may be smaller than the second roof radius of curvature 204*b* and the second roof angle 202*b*. For example, the edge portion 221 of the ridge 220 may have a peak 222 with a first roof radius of curvature 204*a* of less than 0.1 inches, e.g., ranging between 0.02 inches and 0.09 inches, and a first roof angle 202*a* ranging between 110 degrees and 130 degrees, while the central portion 223 of the ridge 220 may have a peak 222 with a second roof radius of curvature 204*b* ranging between 0.1 and 0.2 inches and a second roof angle 202*b* ranging between 135 degrees and 165 degrees.

According to embodiments of the present disclosure, an edge portion 221 of a ridge 220 may have a peak 222 with a first roof radius of curvature 204*a* that is, for example, less than 80 percent (e.g., ranging from 40 to 60 percent) of a second roof radius of curvature 204*b* in a central portion 223 of the ridge 220 and a first roof angle 202*a* that is, for example, less than 80 percent (e.g., ranging from 40 to 60 percent) of a second roof angle 202*b* in the central portion 223 of the ridge 220.

A ridge 220 may have a peak 222 with at least two different roof radii of curvature 204. For example, the peak 222 of a ridge 220 may have relatively smaller roof radii of curvature 204*a* proximate the edges 214 of the top surface 210 than the roof radius of curvature 204*b* in a central portion 223 of the ridge 220. In some embodiments, a ridge 220 may have a peak 222 with more than three different roof radii of curvature 204. In the embodiment shown, the peak 222 has a relatively smaller first roof radius of curvature 204*a* at one side of the ridge 220 and a relatively larger second roof radius of curvature 204*b* at the opposite side of the ridge 220.

Further, the peak 222 of the ridge 220 may have a continuously increasing height 250 along an edge portion 221 of the ridge 220 in a direction from the edge 214 toward the longitudinal axis 201. For example, a ridge 220 may have a peak 222 having a curvature along the y-axis. A roof ridge angle 206 may be defined between a line 228 tangent to the peak 222 of the ridge 220 proximate the edge 214 and a plane 229 perpendicular to the longitudinal axis 201. The roof ridge angle 206 may range from greater than zero to 10 degrees, for example, between 2 and 8 degrees. According to embodiments of the present disclosure, a length of a ridge 220, e.g., an edge portion 221 of the ridge 220, having a first roof radius of curvature 204*a* and first roof angle 202*a* smaller relative to other portions of the ridge 220 may have a roof ridge angle 206 greater than zero degrees.

In embodiments having a chamfer 240 extending around the edge 214 of the ultrahard layer 200, an edge portion 221 of the ridge 220 may include a chamfer 240. In such embodiments, the ridge geometry parameters of the edge portion 221 including the roof angle 202, roof ridge angle 206, and roof radius of curvature 204, may describe the geometry of the ridge peak 222 and sidewalls 232 within the edge portion 221, exclusive of the chamfer 240. In other words, description of ridge geometry parameters of an edge portion 221 having a chamfer 240 may include the roof angle 202, roof ridge angle 206, and roof radius of curvature 204 of the peak 222 and sidewalls 232 extending from an interior boundary 241 of the chamfer 240 in the edge portion 221.

According to embodiments of the present disclosure, the ridge 220 may include one or more concave recesses 270 formed along the peak 222 of the ridge 220. A concave recess 270 may form a concave discontinuous region along the profile of the ridge 220 along its length, e.g., as shown in FIG. 7. In the embodiment shown, the ridge 220 may have one concave recess 270. In other embodiments, a ridge 220 may have more than one concave recess 270. In some embodiments, a ridge 220 may have no concave recesses 270. Further, the concave recess 270 may have a tear-drop shape when viewed from a top perspective (as shown in FIG. 6), where the wider part of the tear-drop is proximate the edge portion 221 and the narrower/sharper part of the tear-drop is proximate the central portion 223 of the ridge 220.

According to embodiments of the present disclosure, a ridge 220 may have a peak 222 with a varying width 225*a*, 225*b* (collectively referred to as 225) measured between opposite points of transition from the peak 222 to the sidewall 230, 232. For example, the peak 222 in the edge portion 221 of the ridge 220 may have a first width 225*a*, and the peak 222 in a remaining portion of the ridge 220, e.g., the central portion 223 of the ridge 220, may have a second width 225*b* that is greater than the first width 225*a*.

In the embodiment shown in FIGS. 4-7, one edge portion 221 of a ridge 220 is modified to have, e.g., a relatively smaller roof angle 202*a* than a central portion 223, a relatively smaller roof radius of curvature 204*a* than the central portion 223, a relatively smaller width 225*a* than the central portion 223, and a roof ridge angle 206, and one concave recess 270 is formed in the ridge 220 radially from the edge portion 221. In some embodiments, both ends of a ridge 220 may be modified to have at least one of a relatively smaller roof angle 202*a* than a central portion 223, a relatively smaller roof radius of curvature 204*a* than the central portion 223, a relatively smaller width 225*a* than the central portion 223, and a roof ridge angle 206. Further, in some embodiments, more than one concave recess 270 may be formed along the ridge 220.

Figure 8:
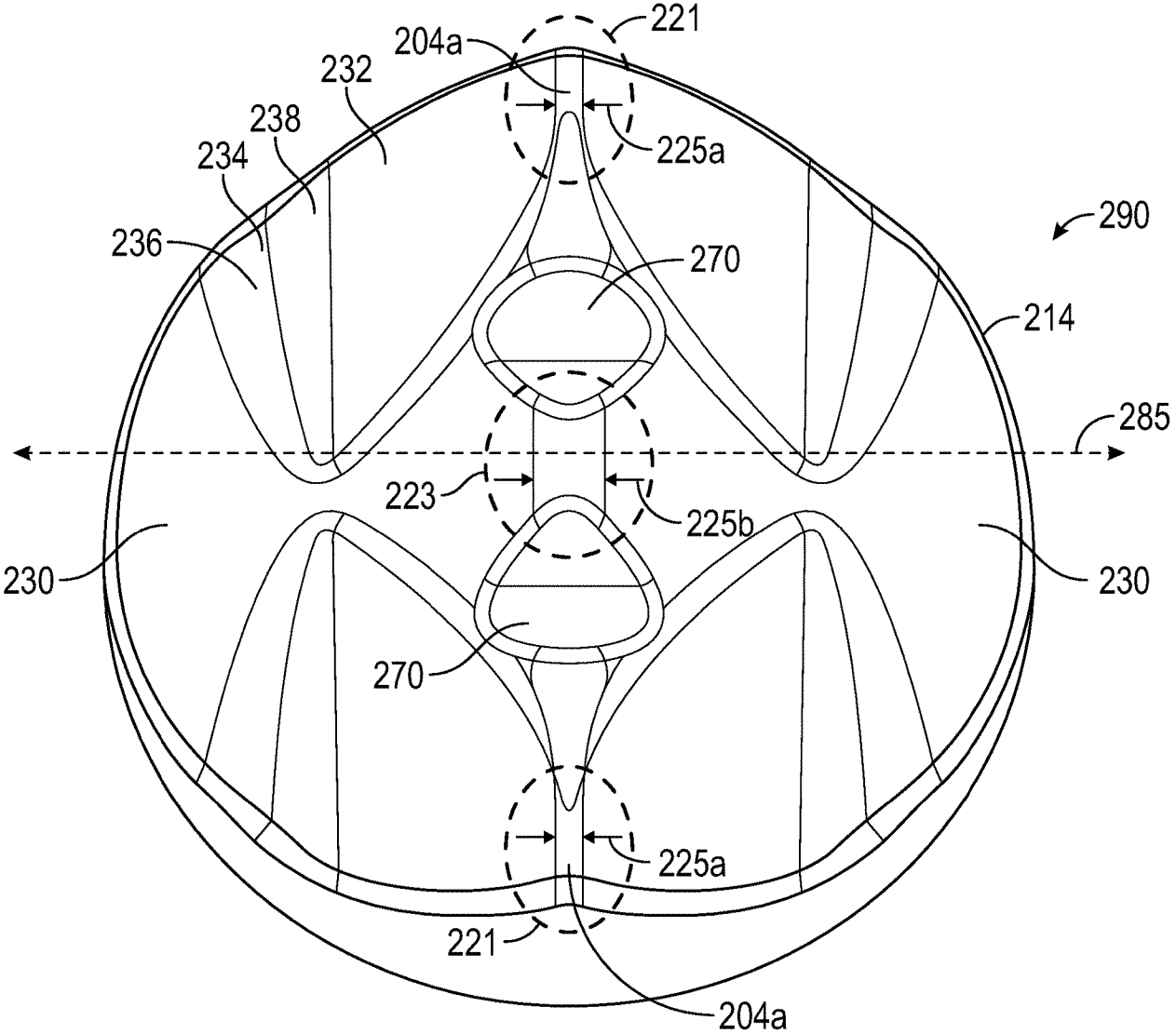
FIG. 8 shows a cutting element according to embodiments of the present disclosure.

For example, FIG. 8 shows an embodiment of a cutting element 290 having a modified edge portion 221 on each end of the ridge 220. Each edge portion 221 may have at least one of a relatively smaller roof angle 202*a* than a central portion 223 of the ridge 220, a relatively smaller roof radius of curvature 204*a* than the central portion 223 of the ridge 220, a relatively smaller width 225*a* than the central portion 223 of the ridge 220, and a roof ridge angle 206. Further, two concave recesses 270 are formed along the ridge 220, each concave recess 270 located radially between an edge portion 221 and the central portion 223. The ridge geometry may be symmetrical about a line 285 extending along a major dimension of the top surface 210 and through the longitudinal axis 201 of the cutting element 290. By providing symmetrical edge portions 221 of a ridge 220, the cutting element 290 may be used in two cutting positions. For example, the cutting element 290 may be positioned in a cutting tool in a first orientation where a first edge portion 221 is oriented to contact and cut a formation during operation. The cutting element 290 may further be positioned in a cutting tool in a second orientation (e.g., if the first edge portion 221 wears or fails from use) where the second edge portion 221 is oriented to contact and cut a formation during operation.

In some embodiments, a ridge 220 may have two different edge portion 221 geometries, which may allow for a single cutting element 200 to have two cutting efficiency options. For example, a cutting element 200 may have a first edge portion 221 extending a first length from an edge 214 of the cutting element 200 and a second edge portion 221 extending a second length from an opposite side of the edge 214, where both the first and second edge portions 221 may have at least two of a relatively smaller roof angle 202*a* than a central portion 223 of the ridge 220, a relatively smaller roof radius of curvature 204*a* than the central portion 223 of the ridge 220, a relatively smaller width 225*a* than the central portion 223 of the ridge 220, and a roof ridge angle 206. At least one geometry parameter in the first edge portion 221 may be different than the second edge portion 221. For example, the first length of the first edge portion 221 may be different from the second length of the second edge portion 221, which may be selected, for example, based on different expected depths of cut.

Figure 9:
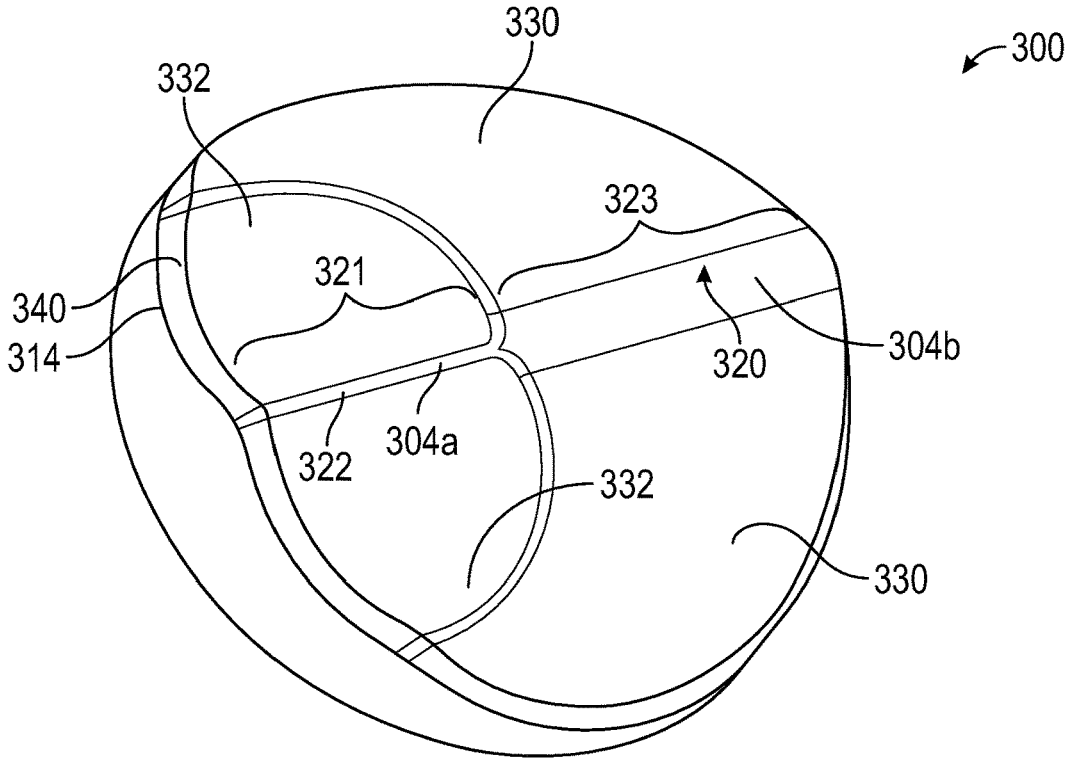
FIG. 9 shows an ultrahard layer according to embodiments of the present disclosure.
Figure 10:
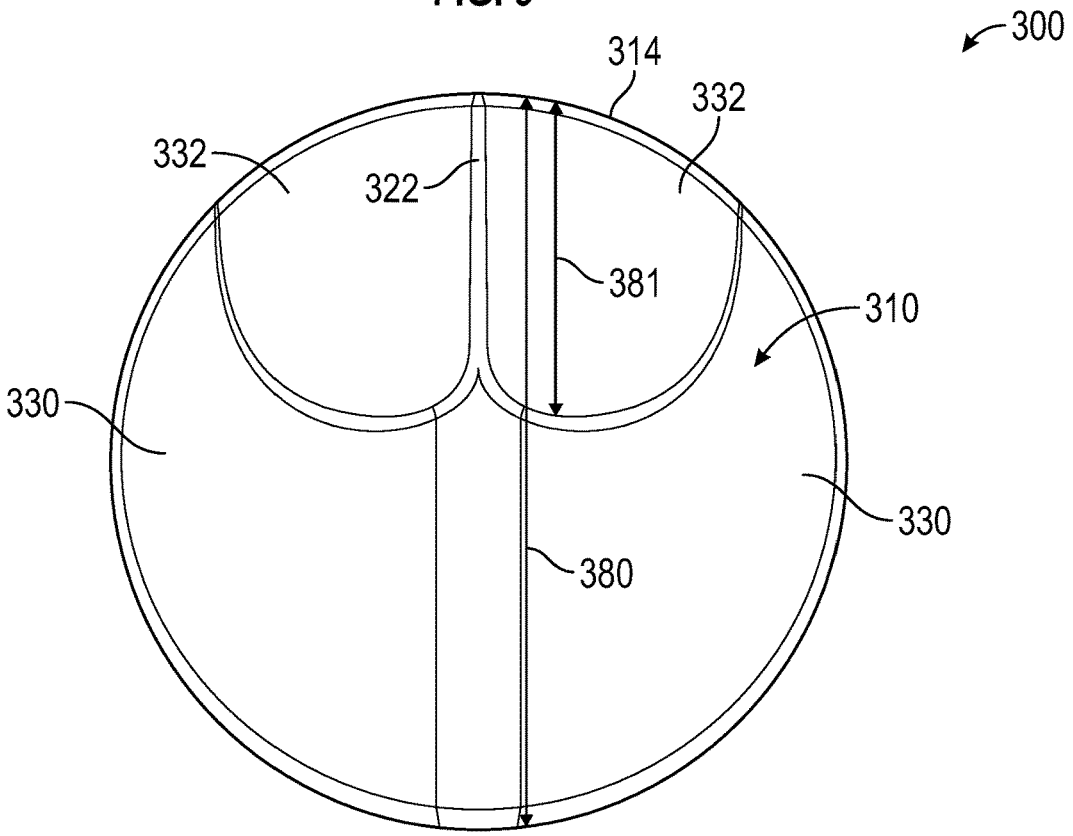
FIG. 10 shows a top view of the ultrahard layer shown in FIG. 9.
Figure 11:
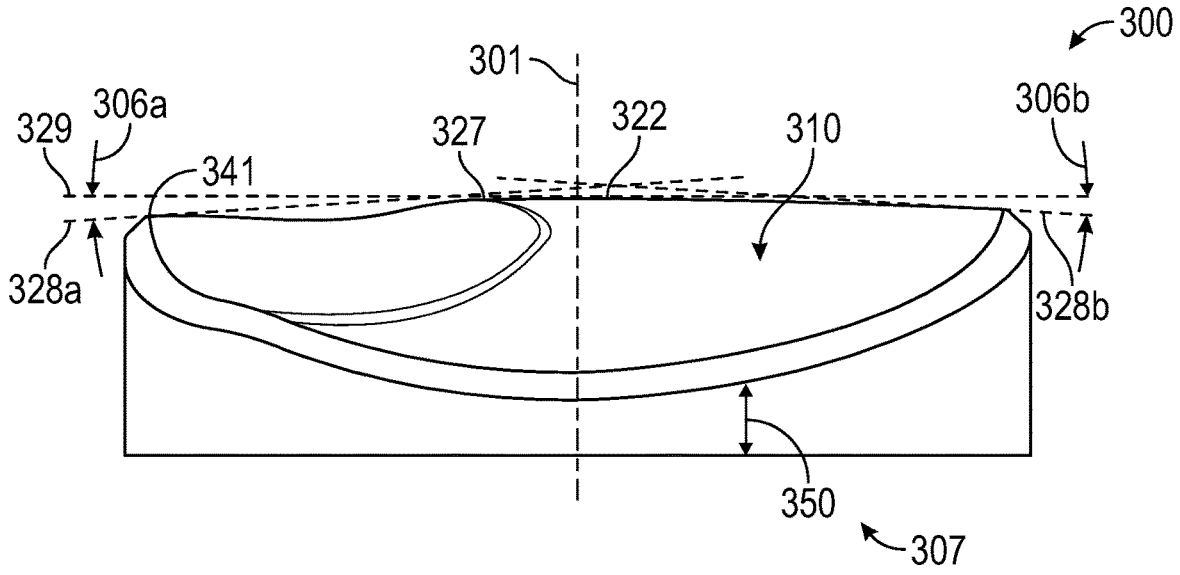
FIG. 11 shows a side view of the ultrahard layer shown in FIGS. 9 and 10.
Figure 12:
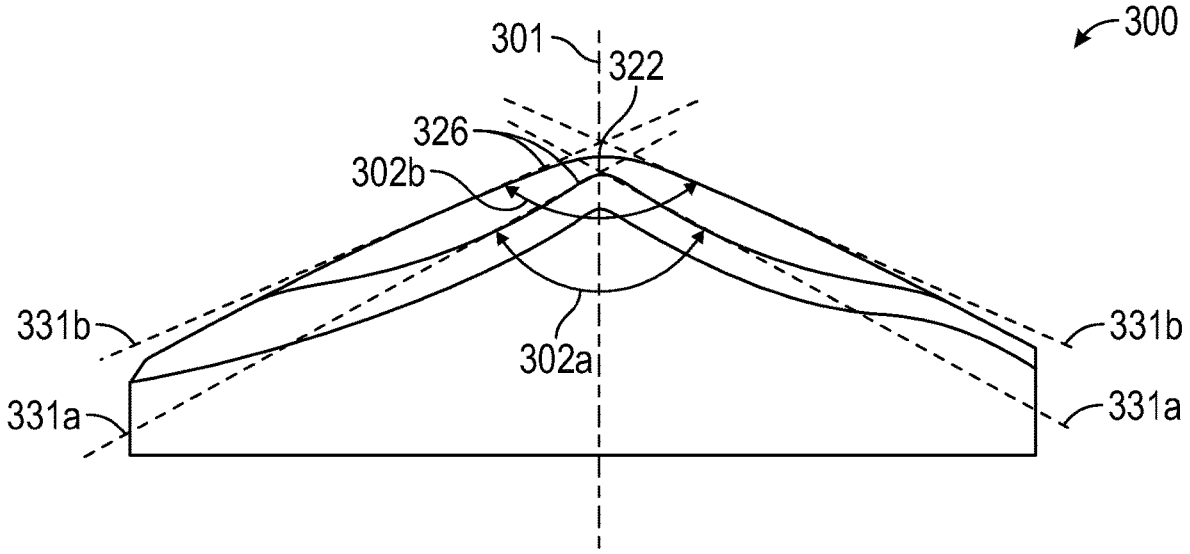
FIG. 12 shows another side view of the ultrahard layer shown in FIGS. 9-11.

FIGS. 9-12 show another example of an ultrahard layer 300 according to embodiments of the present disclosure. FIG. 9 is a perspective view, FIG. 10 is a top view, and FIGS. 11 and 12 are side views of the ultrahard layer 300. The ultrahard layer 300 has a top surface 310 and a bottom surface 307 opposite the top surface, where a thickness 350 of the ultrahard layer 300 is measured axially between the top surface 310 and bottom surface 307 of the ultrahard layer 300.

The top surface 310 of the ultrahard layer 300 has a ridge 320 geometry, which includes a ridge 320 extending a length 380 across the major dimension (e.g., diameter) of the top surface 310. The top surface 310 may also include a chamfer 340 formed around the edge 314 of the top surface 310, where the chamfer 340 extends radially inward from the edge 314 to an interior boundary 341 of the chamfer 340. The ridge 320 includes a peak 322 extending linearly between opposite sides of the edge 314 and sidewalls 330, 332 extending from the peak 322 toward the edge 314. In embodiments having a chamfer 340 formed around the entire edge 314, the peak 322 may extend to and meet with opposite sides of the interior boundary 341 of the chamfer 340.

The ridge 320 may further include an edge portion 321 extending a length 381 from the edge 314 of the top surface 310 that has at least one of a roof ridge angle 306, reduced roof angle 302, and a reduced roof radius of curvature 304 when compared with a remaining portion 323 of the ridge 320. In the embodiment shown in FIGS. 9-12, the edge portion 321 of the ridge may extend a length 381 that is between 25 and 45 percent of the entire length 380 of the ridge 320.

The edge portion 321 of the ridge 320 may have a first roof angle 302*a* measured between oppositely sloping first sidewalls 332 from the peak 322, and the remaining portion 323 of the ridge 320 may have a second roof angle 302*b* measured between oppositely sloping second sidewalls 330. The first sidewalls 332 may appear to be scooped or recessed from the adjacent second sidewalls 330, such that the first sidewalls 332 extend from the peak 322 at a steeper slope relative the longitudinal axis 301 of the ultrahard layer than the second sidewalls 330, and thus, the first roof angle 302*a* is smaller than the second roof angle 302*b*. In embodiments having a convex and/or concave cross sectional profile of a sidewall, such as shown in FIG. 12, where first sidewalls 332 have a concave cross-sectional profile and second sidewalls 330 have a convex cross-sectional profile, the slope of the sidewalls 330, 332 may be measured along a line 331*a*, 331*b* tangent to the portion of the sidewalls 330, 332 extending from a point 326 of transition from the peak 322 to the sidewalls 330, 332.

The edge portion 321 of the ridge 320 may also have a first roof radius of curvature 304*a* that is smaller than a second roof radius of curvature 304*b* of the remaining portion 323 of the ridge 320. For example, the first roof radius of curvature 304*a* may be less than 80 percent, less than 60 percent, less than 50 percent, or less than 40 percent of the second roof radius of curvature 304*b*.

As shown in FIG. 11, the ridge 320 geometry may further include a first roof ridge angle 306*a* formed along the peak 322 in the edge portion 321 of the ridge 320. The first roof ridge angle 306*a* may be formed between a plane 329 perpendicular to the longitudinal axis 301 and a line 328*a* extending along the peak 322 from a point where the peak 322 meets the interior boundary 341 of the chamfer 340 (or the edge 314 in embodiments without a chamfer 340) to a point 327 where the peak 322 transitions to being parallel with the plane 329. The peak 322 in the edge portion 321 of the ridge 320 may have a concave cross-sectional profile when viewed along a profile intersecting the longitudinal axis 301 and extending through the length 312 of the ridge 320. According to embodiments of the present disclosure, the first roof ridge angle 306*a* may be selected from a range of zero to about 10 degrees.

A second roof ridge angle 306*b* may be formed along the peak 322 at the edge 314 opposite the edge portion 321. The portion of the peak 322 proximate the edge 314 and defining a second roof ridge angle 306*b* may have substantially planar cross-sectional profile when viewed along the profile intersecting the longitudinal axis 301 and extending through the length 312 of the ridge 320. In such case, the second roof ridge angle 306*b* may be measured between a line 328*b* tangent to the peak 322 of the ridge 320 proximate the edge 314 and the plane 329 perpendicular to the longitudinal axis 301. According to embodiments of the present disclosure, the second roof ridge angle 306*b* may be selected from a range of zero to about 10 degrees. The second roof ridge angle 306*b* may be less than, greater than, or equal to the first roof ridge angle 306*a*.

Figure 13:
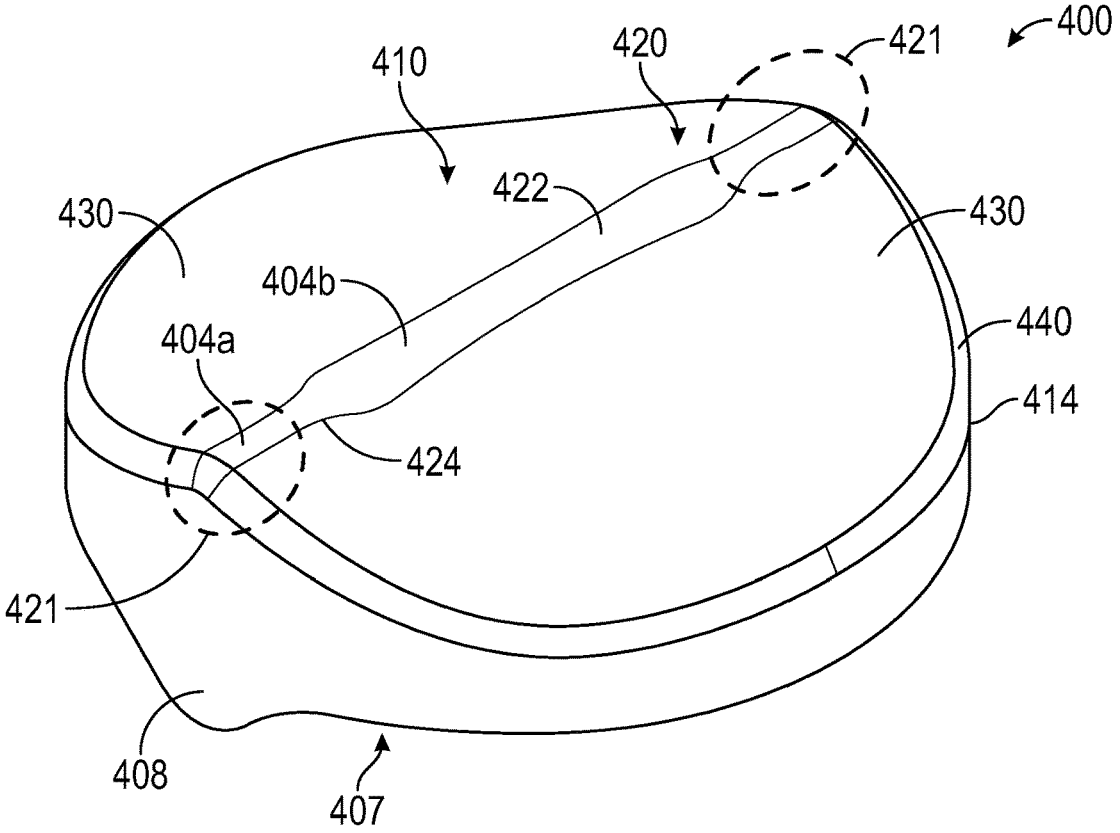
FIG. 13 shows an ultrahard layer according to embodiments of the present disclosure.
Figure 14:
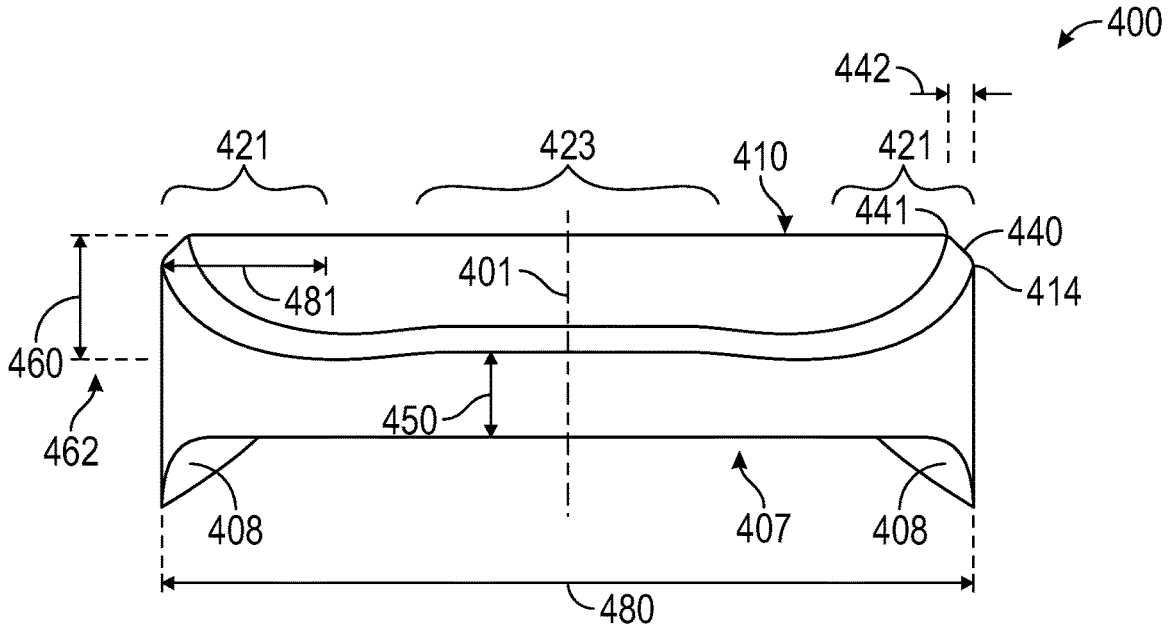
FIG. 14 shows a side view of the ultrahard layer shown in FIG. 13.
Figure 15:
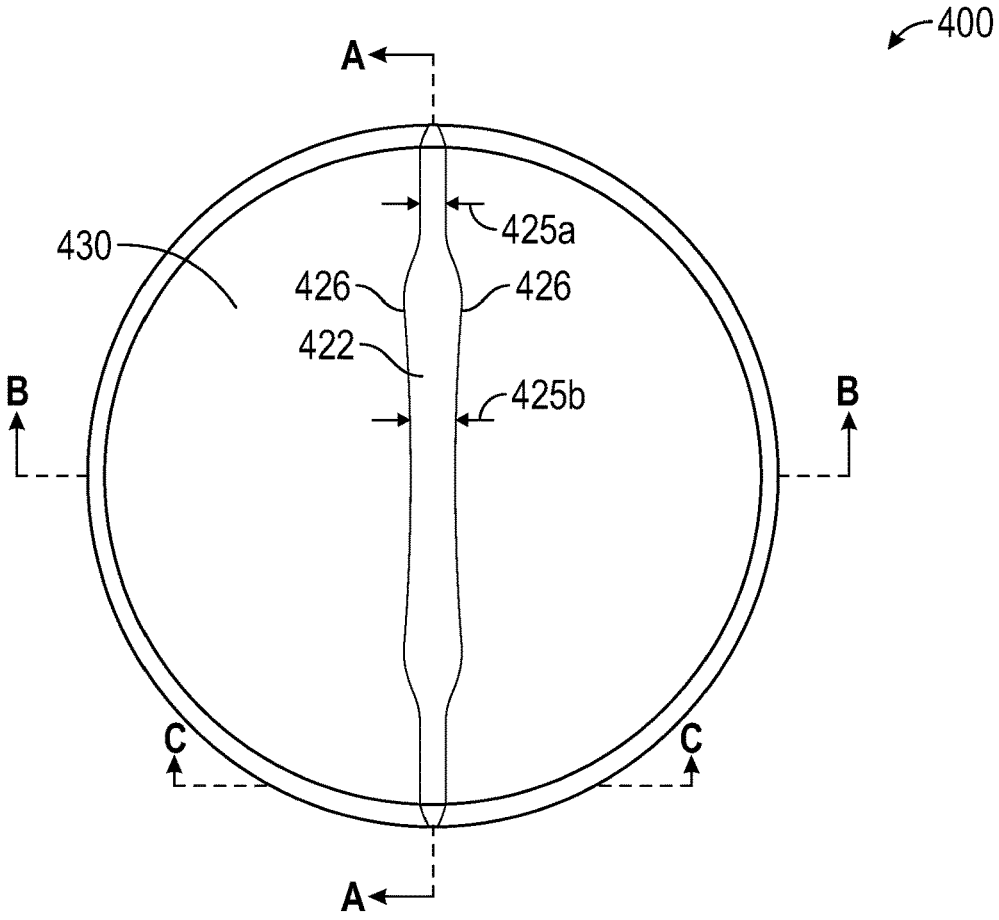
FIG. 15 shows a top view of the ultrahard layer shown in FIGS. 13 and 14.
Figure 16:
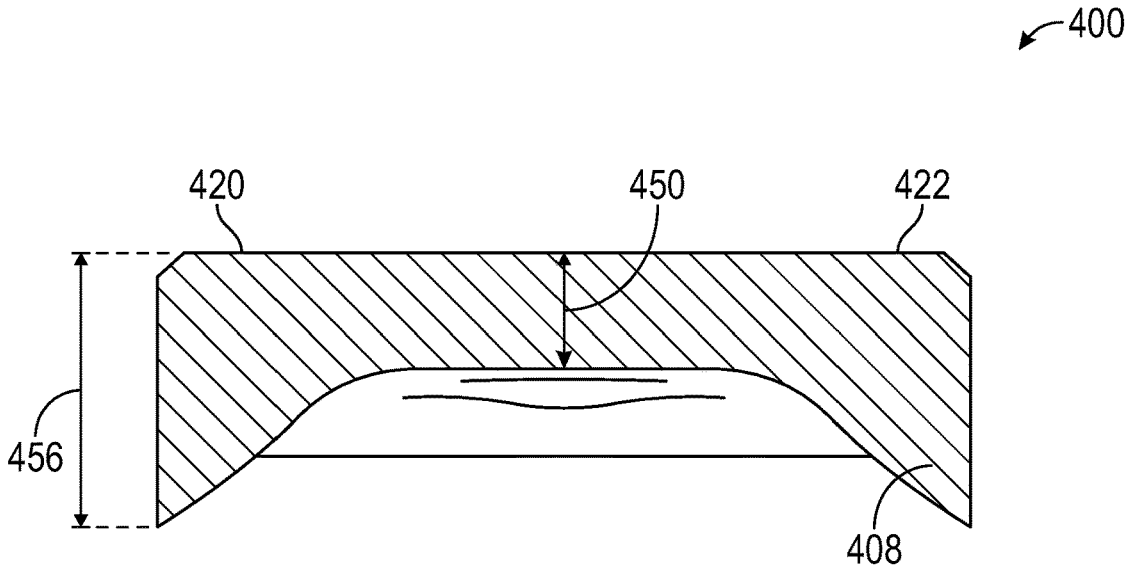
FIG. 16 shows a cross-sectional view of the ultrahard layer of FIGS. 13-15 along a plane intersecting the longitudinal axis of the ultrahard layer and extending through the length of the ridge on the ultrahard layer.
Figure 17:
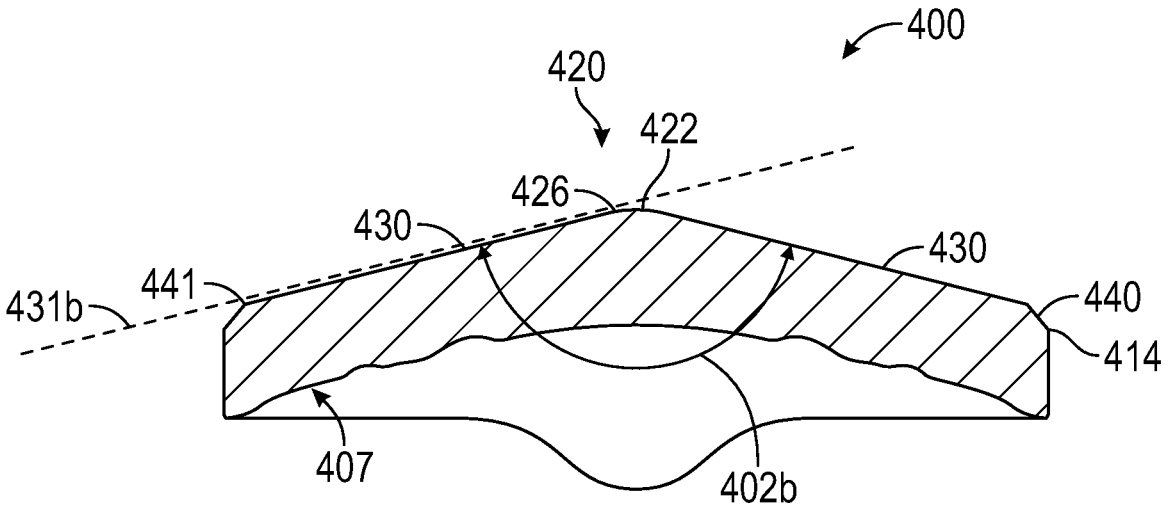
FIG. 17 shows another cross-sectional view of the ultrahard layer of FIGS. 13-16 along a plane intersecting the longitudinal axis of the ultrahard layer and perpendicular to the length of the ridge on the ultrahard layer.
Figure 18:
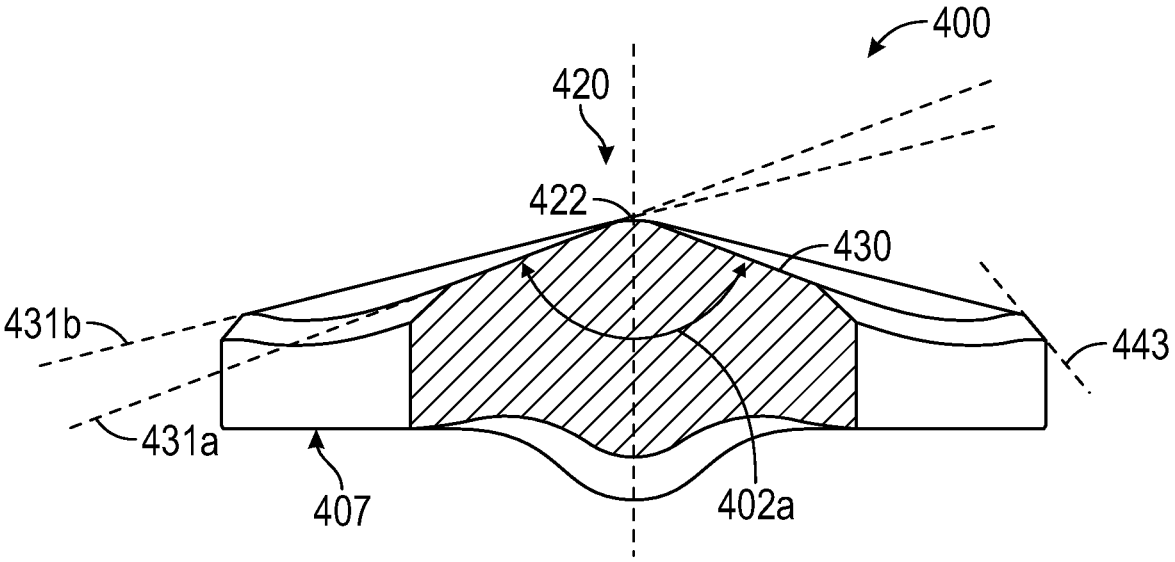
FIG. 18 shows another cross-sectional view of the ultrahard layer of FIGS. 13-17 along a plane parallel to the longitudinal axis of the ultrahard layer and perpendicular to the length of the ridge on the ultrahard layer.

FIGS. 13-18 show another example of an ultrahard layer 400 according to embodiments of the present disclosure. FIG. 13 is a perspective view of the ultrahard layer 400. FIG. 14 is a side view of the ultrahard layer 400. FIG. 15 is a schematic of a top view of the ultrahard layer 400 (looking at the top surface 410 of the ultrahard layer 400). FIGS. 16-18 are cross-sectional views of the ultrahard layer 400 taken along cross-sections A-A, B-B, and C-C, respectively, shown in FIG. 15.

The ultrahard layer 400 has a non-planar top surface 410 with ridge 420 geometry and a non-planar bottom surface 407 opposite the top surface 410. The ridge 420 geometry includes a ridge 420 extending linearly along a major dimension 480 of the ultrahard layer 400 between opposite sides of an edge 414 of the ultrahard layer 400. The ultrahard layer 400 may have a cylindrical side surface 403, where the major dimension 480 of the ultrahard layer 400 is a diameter 480 of the cylindrical side surface 403. In other embodiments, the side surface(s) 403 of an ultrahard layer may define non-circular cross-sectional shapes along a cross-section perpendicular to the longitudinal axis 401, such as oblong, elliptical, or polygonal cross-sectional shapes. The non-planar bottom surface 407 of the ultrahard layer 400 may be attached to (or formed to) an upper surface of a substrate having a geometry corresponding to the bottom surface 407 geometry, forming a non-planar interface between the ultrahard layer 400 and substrate.

In the embodiment shown, the geometry of the bottom surface 407 includes one or more protrusions 408 formed at circumferential positions around the perimeter of the bottom surface 407, for example, at opposite sides of a diameter 480 of the ultrahard layer 400. In some embodiments, one or more protrusions 408 may be formed at a circumferential position around the ultrahard layer 400 that corresponds with an edge portion 421 of a ridge 420 formed on the top surface 410. For example, as shown in FIGS. 13 and 14, protrusions 408 may be formed on the bottom surface 407 at circumferential positions opposite edge portions 421 of the ridge 420. The ultrahard layer 400 may be attached or formed to a substrate having an upper surface with a corresponding geometry to the bottom surface 407 of the ultrahard layer 400, e.g., one or more recessed portions having a corresponding shape to one or more protrusions 408 formed on the bottom surface 407 of the ultrahard layer 400.

A thickness 450 of the ultrahard layer 400 is measured axially between the top surface 410 and bottom surface 407 of the ultrahard layer 400. According to embodiments of the present disclosure, the ultrahard layer 400 may have a combination top surface 410 geometry and bottom surface 407 geometry to provide the ultrahard layer 400 with the greatest thickness 456 at the edge portions 421 of the ridge 420 relative to the remaining areas of the ultrahard layer 400.

The ridge 420 geometry of the top surface 410 includes a peak 422 of the ridge 420 and sidewalls 430 extending outwardly from the peak 422 to an interior boundary 441 of a chamfer 440 formed around the edge 414 of the top surface 410 (or in embodiments without a chamfer 440, extending to the edge 414 of the top surface 410). The peak 422 may have a width 425 measured between opposite points 426 of transition from the peak 422 to a sidewall 430. The transition from the peak 422 to a sidewall 430 may be angled or radiused. The width 425 of the peak 422 may vary along the length 480 of the ridge 420. For example, the peak 422 in the edge portions 421 of the ridge 420 may have a first width 425*a*, and the portion of the peak 422 extending between the opposite edge portions 421 (e.g., including a central portion 423 around the longitudinal axis 401 of the ultrahard layer) may have a second width 425*b* greater than the first width 425*a*.

According to embodiments of the present disclosure, the first width 425*a* of a peak 422 in an edge portion 421 of a ridge 420 may be, for example, between 20 percent to 80 percent less than the second width 425*b* of the peak 422 in the central portion 423 of the ridge 420. For example, in the embodiment shown, the peak 422 in the edge portions 421 of the ridge 420 may have a first width 425*a* ranging between 20 percent to 50 percent less than the second width 425*b* of the portion of the peak 422 extending between the edge portions 421. The width values may vary depending on the overall size of the ultrahard layer 400 and the other dimensions of the ridge geometry, such as the ridge height 460, roof angle 402, roof radius of curvature 404, and roof ridge angle (e.g., 206). In some embodiments, a first width 425*a* of the peak 422 in the edge portions 421 may range, for example, between 0.02 inches to 0.05 inches, or between 0.03 inches to 0.06 inches, and the second width 425*b* of the portion of the peak 422 extending between the edge portions 421 may range, for example, between 0.04 inches to 0.08 inches, or between 0.05 inches to 0.1 inch.

The roof radius of curvature 404 is a measurement of the curvature of the peak 422 and may vary along the length 480 of the ridge 420. For example, in the embodiment shown in FIGS. 13-18, the peak 422 may have a first roof radius of curvature 404*a* in the edge portions 421 of the ridge 420 and a second roof radius of curvature 404*b* in the central portion 423 of the ridge 420, where the second roof radius of curvature 404*b* is greater than the first roof radius of curvature 404*a*. According to embodiments of the present disclosure, the roof radius of curvature 404 of a peak 422 in edge portion(s) 421 of a ridge 420 may be smaller than the roof radius of curvature 404 of the peak 422 in portions of the ridge 420 interior to and adjacent to the edge portion(s) 421. For example, the first roof radius of curvature 404*a* of the peak 422 in the edge portions 421 of a ridge 420 may range from about 20 percent to 60 percent less than the roof radius of curvature 404 of a portion of the ridge 420 adjacent to and interior to the edge portions 421.

In some embodiments, the first roof radius of curvature 404*a* of the peak 422 in an edge portion 421 of a ridge 420 may vary along the length of the edge portion 421 and/or the roof radius of curvature 404 may vary along the remaining portion of the ridge 420, where the greatest value of the first roof radius of curvature 404*a* may be less than the roof radius or radii of curvature 404 along the remaining portion of the ridge 420. For example, the first roof radius of curvature 404*a* of the peak 422 in the edge portions 421 of a ridge 420 may be less than 0.1 inches, e.g., ranging from a lower limit of 0.02 inches, 0.04 inches, or 0.06 inches to an upper limit of 0.05 inches, 0.08 inches, or 0.09 inches, and a portion of the ridge 420 adjacent to and interior to the edge portions 421 may have a roof radius of curvature that is 0.1 inches or greater, e.g., ranging from a lower limit of 0.1 inches, 0.14 inches, or 0.15 inches to an upper limit of 0.15 inches, 0.2 inches, or 0.25 inches.

In some embodiments, at least a portion of the ridge 420 extending between the edge portions 421 may have a peak 422 with a planar surface, in which case the radius of curvature 404 of the planar surface portion of the peak 422 would be infinity.

The ridge 420 may further have a roof angle 402 measured between oppositely sloping sidewalls 430 from the peak 422. The slope of a sidewall 430 may be measured along a line 431 extending from an interior boundary 441 of a chamfer 440 (or from the edge 414 in embodiments without a chamfer 440) to a point 426 of transition from the peak 422 to the sidewall 430. In embodiments having planar sidewalls 430, the line 431 may be tangent to the sidewall 430 surface. According to embodiments of the present disclosure, the roof angle 402 may vary along the length 480 of the ridge 420. For example, in the embodiment shown in FIGS. 13-18, the edge portions 421 of the ridge 420 may have a first roof angle 402*a* smaller than a second roof angle 402*b* along a central portion 423 of the ridge 420. As shown in FIG. 17 which is a cross-sectional view of the ultrahard layer 400 taken at plane B-B from FIG. 15 through the central portion 423 of the ridge 420, the second roof angle 402*b* is measured between the lines 431*b* tangent to the sidewalls 430 extending laterally from the peak 422 toward the edge 414 of the ultrahard layer 400. As shown in FIG. 18, which is a cross-sectional view of the ultrahard layer 400 taken at plane C-C from FIG. 15 through an edge portion 421 of the ridge 420, the first roof angle 402*a* is measured between the lines 431*a* tangent to the sidewalls 430 extending laterally from the peak 422 toward the edge 414 of the ultrahard layer 400.

According to embodiments of the present disclosure, a first roof angle 402*a* of an edge portion 421 of a ridge 420 may be less than 145 degrees, for example, ranging between 100 degrees and 145 degrees. The sidewalls 430 on opposite sides of the peak 422 in the portion of the ridge 420 between the edge portions 421 (including central portion 423) may extend from the peak 422 at a second roof angle greater than 135 degrees, for example, ranging between 140 degrees and 170 degrees. The sidewalls 430 may transition from sloping at the first roof angle 402*a* from the peak 422 to sloping at the second roof angle 402*b* from the peak 422 along a radiused or curved transition 424 along the peak 422. Further, the transition between the sidewalls sloping at the first roof angle 402*a* (represented by tangent line slope 431*a*) and the sidewalls sloping at the second roof angle 402*b* (represented by tangent line slope 431*b*) may be gradual, such that there is a continuously changing slope between the first slope 431*a* and the second slope 431*b*.

The ridge 420 may have a ridge height 460 measured axially from a lowest portion 462 of the edge 414 to the ridge peak 422. According to embodiments of the present disclosure, the ridge height 460 may range, for example, from a lower limit of 0.05 inches, 0.08 inches, or 0.1 inch to an upper limit of 0.07 inches, 0.1 inch, 0.15 inches, or 0.2 inches. In some embodiments, the ridge height 460 may vary along the length 480 of the ridge 420. For example, in embodiments where the peak 422 of the ridge 420 slopes at a roof ridge angle (e.g., 206 in FIG. 7), the ridge height 460 may continuously change along the sloping portion of the ridge 420. In embodiments having one or more concave recesses (e.g., 270 in FIG. 6), the ridge height 460 may vary between the peak 422 and the concave recess(es). In embodiments such as shown in FIGS. 13-18 having a ridge 420 with a roof ridge angle of zero and no concave recesses, the peak 422 may be at a uniform ridge height 460 along the entire length 480 of the ridge 420.

According to embodiments of the present disclosure, the length 481 of an edge portion 421, as measured by a radial distance from the edge 414 of the top surface 410 toward the longitudinal axis 401, may be designed to be greater than or equal to a predicted depth of cut when the cutting element is cutting. For example, in some embodiments, the length 481 of the edge portion 421 may range from about 0.07 inches to 0.3 inches. In embodiments having a chamfer 440 formed around the edge 414, the peak 422 of the ridge 420 within the edge portion 421 may extend radially inward from an interior boundary 441 of the chamfer 440. A chamfer may extend a radial distance 442 between the edge 414 of the ultrahard layer 400 to the interior boundary 441 of the chamfer 440 ranging, for example, from about 0.01 inches to about 0.03 inches. Further, a chamfer may have a slope 443 with respect to the longitudinal axis 401 ranging from, for example, about 40 degrees to about 50 degrees or 15 degrees to 70 degrees.

The geometry of the ridge 420 in an edge portion 421 may include a peak 422 having a reduced roof angle 402 and a reduced roof radius of curvature 404 relative to a central portion 423 of the ridge. Further, ridge 420 geometry may include opposite ends of the ridge 420 (two edge portions 421) having a peak width 425*a* that is less than the peak width 425*b* in a central portion 423 of the ridge 420. Such ridge geometry may provide edge portion(s) 421 having a relatively reduced contacting area (i.e., the area of the top surface 410 and side surface 403 of the edge portion 421 that contacts a formation during operation), which may reduce the workload of the cutting element when cutting.

Ridge geometry may vary while still providing edge portion(s) of the ridge having at least one of a reduced roof angle, a reduced roof radius of curvature, and a reduced peak width relative to a central portion of the ridge. For example, FIGS. 19-24 show additional examples of cutting elements having a ridge geometry according embodiments to the present disclosure, where the edge portion(s) of the ridge have at least one of a reduced roof angle, a reduced roof radius of curvature, and a reduced peak width relative to a central portion of the ridge.

Figure 19:
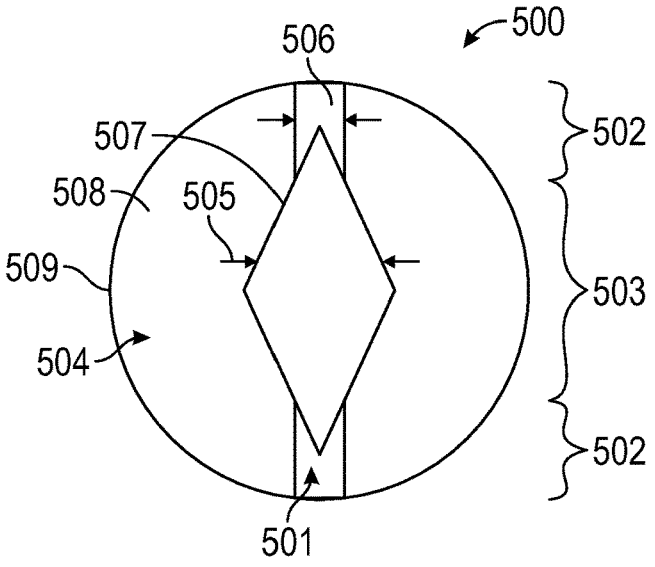
FIG. 19 shows a top view of a cutting element according to embodiments of the present disclosure.
Figure 20:
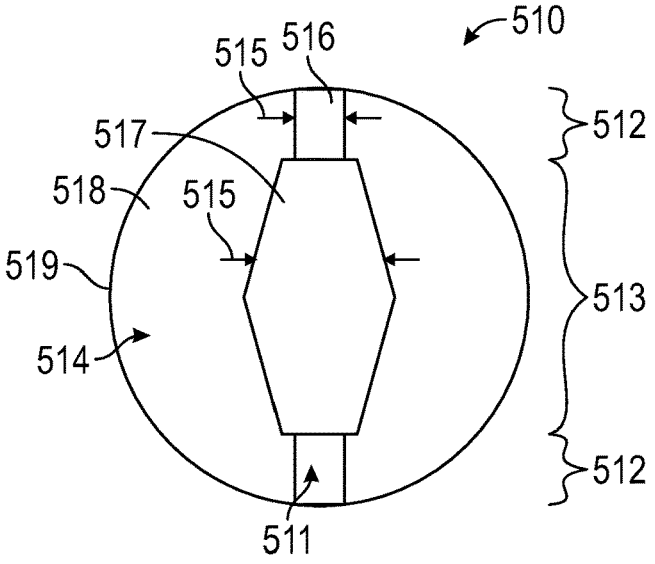
FIG. 20 shows a top view of a cutting element according to embodiments of the present disclosure.
Figure 21:
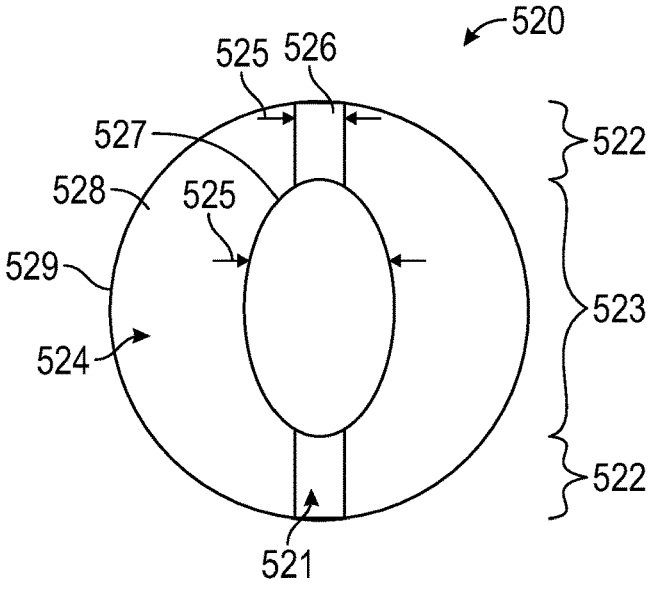
FIG. 21 shows a top view of a cutting element according to embodiments of the present disclosure.

FIGS. 19-21 show top views of cutting elements 500, 510, 520 having ridge 501, 511, 521 geometries that include edge portions 502, 512, 522 having a reduced peak width 505, 515, 525 relative to a central portion 503, 513, 523 of the ridge 501, 511, 521. As shown in FIG. 19, the ridge 501 extends linearly across a major dimension of the top surface 504, where edge portions 502 of the ridge 501 are at opposite ends of the ridge 501. A central portion 503 of the ridge 501 extending between the two edge portions 502 has a peak width 505 that is greater than the peak width 505 along the edge portions 502. The peak width 505 is measured between opposite points 507 of transition from the peak 506 of the ridge 501 to the sidewalls 508 extending outwardly from the peak 506 toward an edge 509 of the top surface 504.

The central portion 503 of the ridge 501 may have a peak 506 with a planar surface having a polygonal shape, which is a diamond-shaped in the embodiment shown in FIG. 19. The planar surface portion of the peak 506 (in the central portion 503 of the ridge 501) may have its planar surface extending along a plane (e.g., plane 329 in FIG. 11) perpendicular to the longitudinal axis (e.g., 301 in FIG. 11) of the cutting element. The transitions 507 from the planar surface of the peak 506 in the central portion 503 to the sidewalls 508 of the ridge 501 may be curved or radiused. Further, the peak 506 may be a curved surface along the edge portions 502 of the ridge 501, where the curved surface peak 506 portions may have a roof radius of curvature (e.g., 404*a*, 404*b* in FIG. 13) ranging from, for example, less than 0.1 inches.

FIG. 20 shows another example of a cutting element 510 with a ridge 511 geometry having a central portion 513 of the ridge 511 with a peak 516 having a polygonal shape. The ridge 511 extends linearly across a major dimension of the top surface 514, where edge portions 512 of the ridge 511 extend inwardly from opposite sides of the edge 519 of the top surface 514 to a central portion 513 of the ridge 511. The width 515 of the peak 516 in the central portion 513 is greater than the width 515 of the peak 516 along the edge portions 512. The peak width 515 is measured between opposite points 517 of transition from the peak 516 of the ridge 511 to the sidewalls 518 extending outwardly from the peak 516 toward the edge 519 of the top surface 514.

FIG. 21 shows an example of a cutting element 520 with a ridge 521 geometry having a central portion 523 of the ridge 521 with an oval-shaped peak 526 surface. The ridge 521 extends linearly across a major dimension of the top surface 524, where edge portions 522 of the ridge 521 extend inwardly from opposite sides of the edge 529 of the top surface 524 to the central portion 523 of the ridge 521. The width 525 of the peak 526 in the central portion 523 is greater than the width 525 of the peak 526 along the edge portions 522. The oval-shaped portion of the peak 526 may have a planar surface, while the peak 526 in the edge portions 522 may have a curved surface with a radius of curvature (e.g., 404*a*, 404*b* in FIG. 13) ranging from, for example, less than 0.1 inches.

According to some embodiments of the present disclosure, the width 525 of the peak 526 in the central portion 523 of the ridge 521 may be up to 2 times greater than the width 525 at the edge portion 522, up to 3 times greater than the width 525 at the edge portion 522, or more. In some embodiments, the width of a peak in the central portion of the ridge may extend greater than 20 percent of the major dimension, greater than 50 percent of the major dimension, or up to the entire major dimension.

Figure 22:
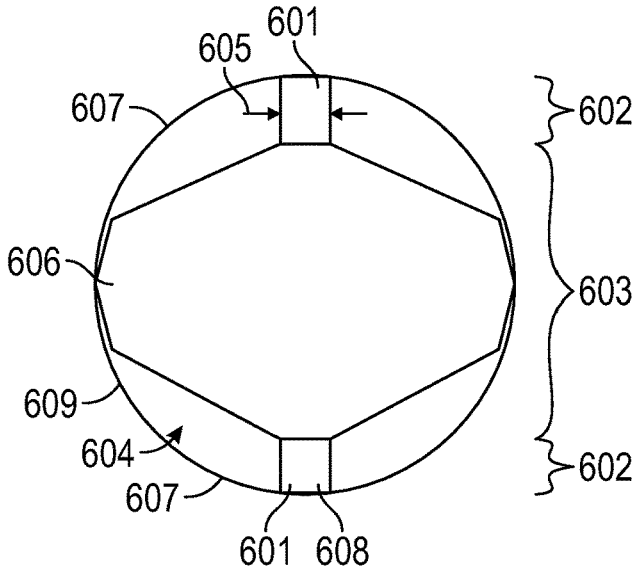
FIG. 22 shows a top view of a cutting element according to embodiments of the present disclosure.
Figure 23:
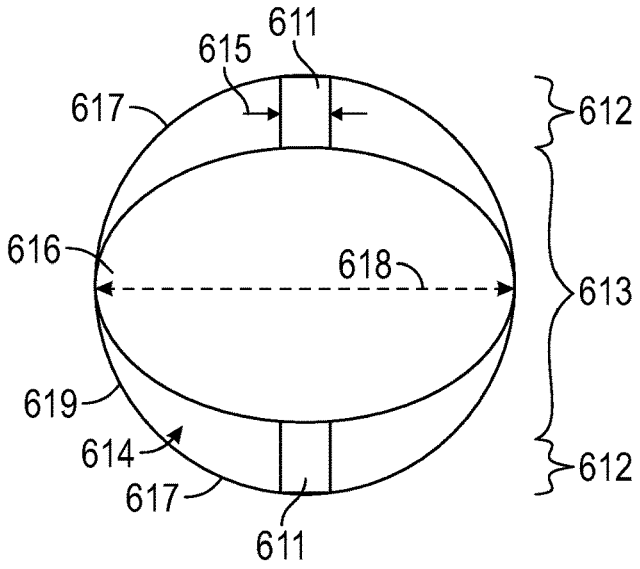
FIG. 23 shows a top view of a cutting element according to embodiments of the present disclosure.
Figure 24:
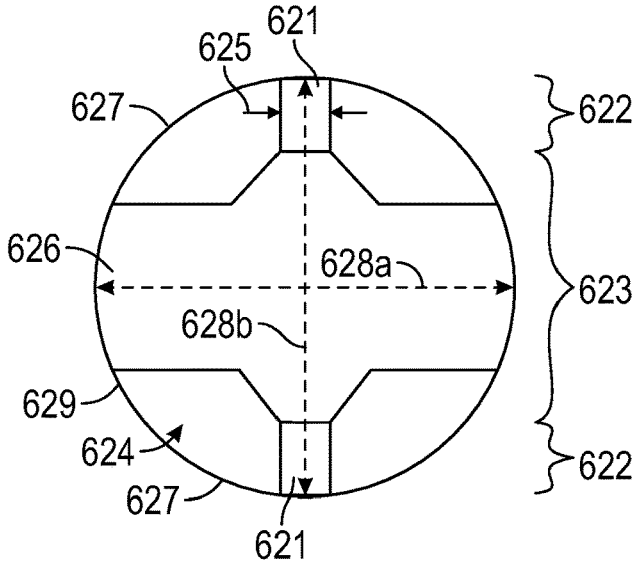
FIG. 24 shows a top view of a cutting element according to embodiments of the present disclosure.

FIGS. 22-24 show top views of cutting elements 600, 610, 620 having ridge geometry that includes a central portion 603, 613, 623 of the ridge 601, 611, 621 that extends to opposite sides of the edge 609, 619, 629 of the top surface 604, 614, 624, across a major dimension of the top surface 604, 614, 624. The edge portions 602, 612, 622 of the ridge 601, 611, 621 have a reduced peak width 605, 615, 625 relative to the central portion 603, 613, 623 of the ridge 601, 611, 621.

Described another way, the cutting element 600, 610, 620 ridge geometry may include a geometric surface 606, 616, 626 axially extended from a plurality of recessed edge portions 607, 617, 627 formed around the edge 609, 619, 629 of the top surface 604, 614, 624. At least one ridge 601, 611, 621 extends radially outward from the geometric surface 606, 616, 626 to the edge 609, 619, 629 of the top surface 604, 614, 624. Sidewalls may slope downwardly from the geometric surface 606, 616, 626 and ridge 601, 611, 621 to the recessed edge portions 607, 617, 627.

As shown in FIG. 22, the ridge geometry includes a geometric surface 606 axially extended from multiple recessed edge portions 607 formed around the edge 609 of the top surface 604, where the geometric surface 606 has a polygonal shape. The ridges 601 may have a curved peak 608 with a roof radius of curvature, and the geometric surface 606 may be a planar surface. Further, the peak 608 of the ridges 601 and the geometric surface 606 may lie on a shared plane (e.g., plane 329 in FIG. 11) perpendicular to the longitudinal axis of the cutting element 600. In some embodiments, the peak 608 of one or more ridges 601 may slope at a roof ridge angle from the geometric surface 606 (e.g., where a line tangent to the ridge peak 608 may slope at a roof ridge angle from the plane perpendicular to the longitudinal axis, such as shown in FIG. 11).

FIG. 23 shows another example of ridge geometry according to embodiments of the present disclosure, where a geometric surface 616 is axially extended from multiple recessed edge portions 617 formed around the edge 619 of the top surface 614. The geometric surface 616 may have an oval shape or other elongated curved shape. Further, the geometric surface 616 may extend across an entire major dimension 618 between opposite sides of the edge 619 of the top surface 614.

In some embodiments, a geometric surface may have an irregular shape, e.g., including both straight and curved boundary lines. For example, FIG. 24 shows a cutting element 620 with a ridge geometry including a geometric surface 626 axially extended from multiple recessed edge portions 627 formed around the edge 629 of the top surface 624, where the geometric surface 626 has an irregular shape. The geometric surface 626 may extend across an entire major dimension 628*a* between opposite sides of the edge 629 of the top surface 624. Further, the geometric surface 626 may have a shape that is symmetrical across both a line 628*b* bisecting the length of the ridges 621 and across the major dimension 628*a* of the geometric surface 626.

As shown in the embodiments shown in FIGS. 19-24, at least a portion of a ridge peak may be formed of a planar surface lying along a plane perpendicular to the longitudinal axis of the cutting element. For example, as described above, the portion of the peaks forming a geometric surface may be a planar surface, while the portions of the peaks in the edge portions may be formed of a curved surface having a radius of curvature. In some embodiments, such as described below, a ridge peak may be entirely formed of a planar surface (along the entire length of the peak).

For example, FIGS. 25-28 show another example of a cutting element 700 according embodiments to the present disclosure having a ridge geometry formed on a top surface 710 of an ultrahard layer, where the edge portion(s) 721 of the ridge 720 have at least one of a reduced roof angle, a reduced roof radius of curvature, and a reduced peak width relative to a central portion of the ridge. The ridge geometry of the top surface 710 includes a peak 722 of the ridge 720 and sidewalls 730 extending outwardly from the peak 722 to an interior boundary 741 of a chamfer 740 formed around the edge 714 of the top surface 710 (or in embodiments without a chamfer 740, extending to the edge 714 of the top surface 710). The ridge 720 extends a length 780 linearly across a major dimension of the top surface 710, where edge portions 721 of the ridge 720 extend a length 781 inwardly from opposite sides of the edge 714 of the top surface 710 to a central portion 723 of the top surface 710.

The sidewalls 730 may extend downwardly and outwardly from the peak 722 to the interior boundary 741 of the chamfer 740 at a roof angle 702. The roof angle 702 may be measured between the lines 731 tangent to the sidewalls 730 proximate to the peak 722. The roof angle 702 may be substantially constant along the length 780 of the peak 722. The roof angle 702 may range, for example, between about 140 degrees to about 155 degrees.

The peak 722 may be formed of a planar surface extending substantially perpendicular to the longitudinal axis 701 along the length 780 of the ridge 720. The peak 722 planar surface may form a geometric surface (e.g., as described in FIGS. 22-24) having a geometry defined between opposite points 726 of transition from the peak 722 to a sidewall 730 and between opposite sides of the chamfer 740.

Figure 25:
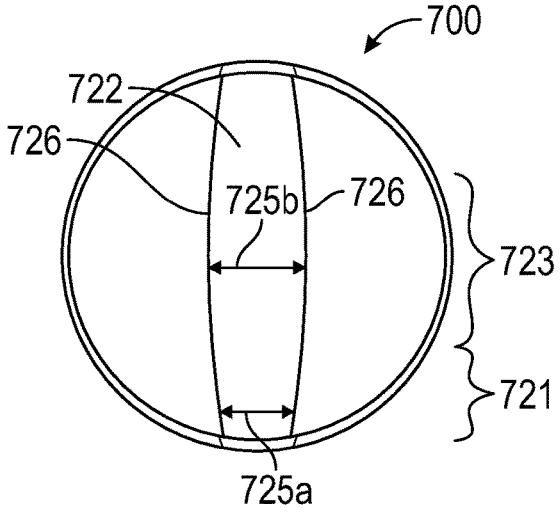
FIGS. 25-28 show different views of a cutting element according to embodiments of the present disclosure.
Figure 26:
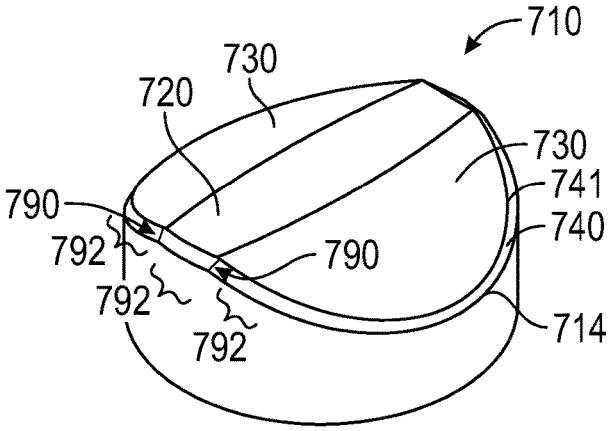
Figure 27:
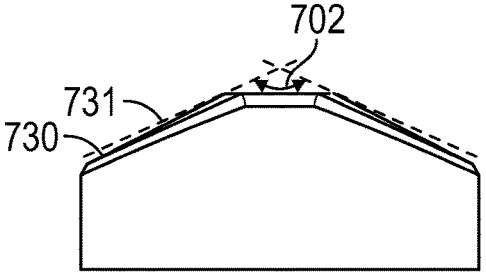
Figure 28:
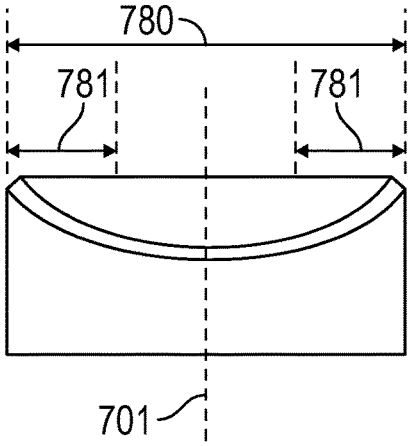

A width 725 of the peak 722 may be measured between opposite points 726 of transition from the peak 722 to a sidewall 730. The transition from the peak 722 to a sidewall 730 may be angled or radiused. The width 725 of the peak 722 may vary along the length 780 of the ridge 720. For example, the peak 722 in the edge portions 721 of the ridge 720 may have a first width 725*a* proximate the edge 714 of the top surface 710, and the portion of the peak 722 in a central portion of the top surface 710 around the longitudinal axis 701 may have a second width 725*b* greater than the first width 725*a*. Further, as shown in FIG. 25, the width 725 of the peak 722 may gradually and continuously increase from the first width 725*a* proximate the edge 714 toward the central portion of the top surface 710.

According to embodiments of the present disclosure, the first width 725*a* proximate the edge 714 of the peak 722 may range, for example, between about 0.05 to about 0.15 inches. By providing a first width 725*a* of about 0.05 inches or more proximate the edge 714 of the cutting element, the peak 722 may form two cutting tips 790 that may act as pinch points to build stress concentrations on a working surface, e.g., a rock formation being drilled, and to reduce forces required for the rock fracturing. Three cutting edges 792 alternatingly formed around the cutting tips 790 may also help with rock fracturing.

Figure 29:
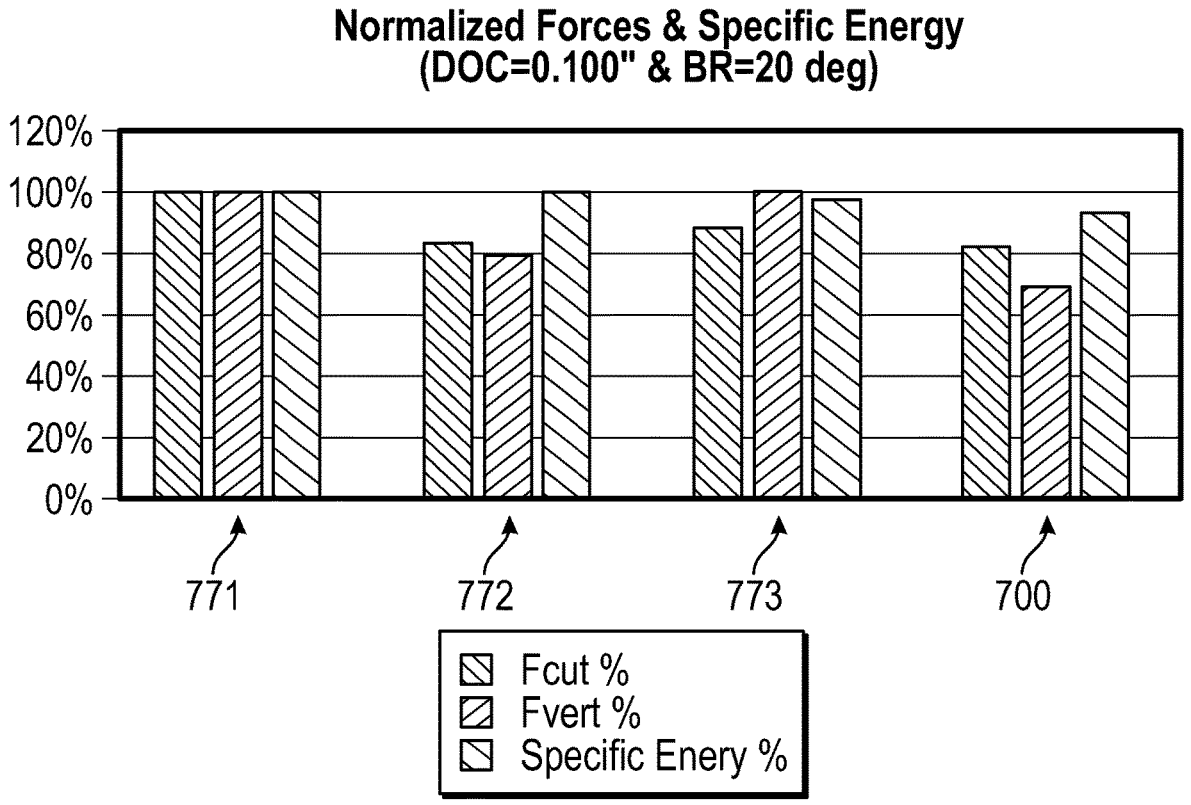
FIG. 29 shows a graph comparing forces and specific energy during testing of different cutting element types with a cutting element according to embodiments of the present disclosure.
Figure 30:
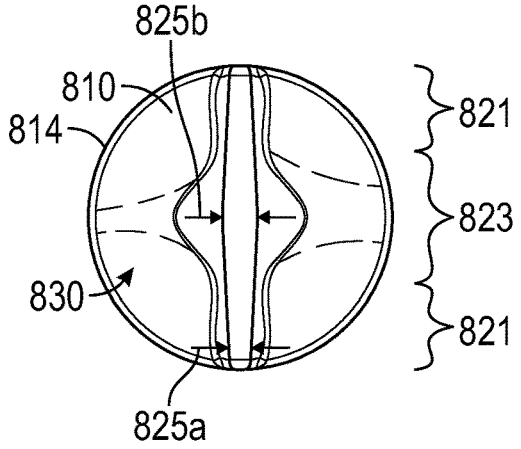
FIGS. 30-34 show different views of a cutting element according to embodiments of the present disclosure.
Figure 31:
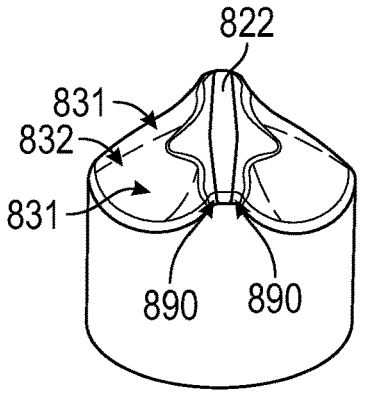
Figure 32:
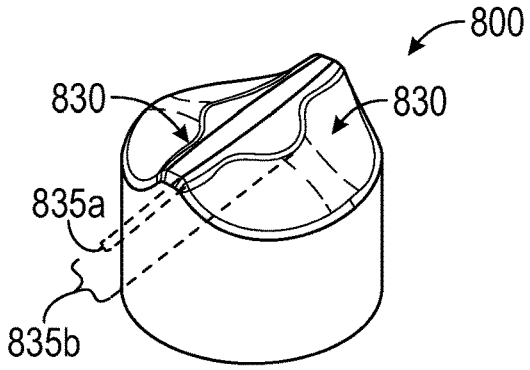
Figure 33:
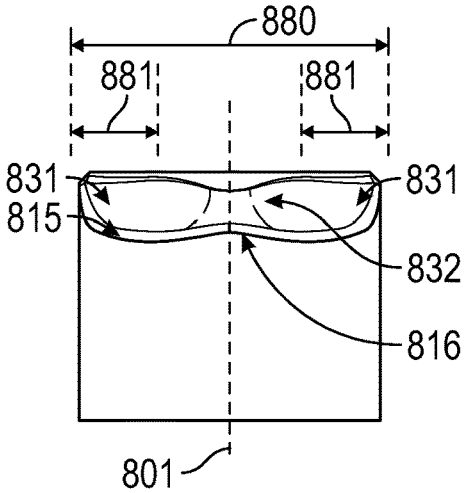

Further, cutting elements according to embodiments of the present disclosure having a peak 722 with a first width 725*a* proximate the edge 714 of the cutting element of about 0.1 inch, a second width 725*b* greater than the first width 725*a*, and a roof angle 702 of about 140 degrees have been shown experimentally to have a lower cutter specific energy (i.e., the energy required to remove a unit volume of rock for a single cutting element) when compared with cutting elements having different cutting face geometry. For example, FIG. 29 shows a graph of test results comparing cutting performance of a conventional planar top cutting element 771, a cutting element 772 having a ridge with a uniform curved peak along its length, a cutting element 773 having a ridge geometry such as shown in FIGS. 13-18, and a cutting element 700 having a ridge geometry such as shown in FIGS. 25-28 with a peak first width 725*a* of about 0.1 inches and a roof angle of about 140 degrees. The graph shows the measured normalized forces (cutting force and vertical force) and specific energy of the cutting elements 771, 772, 773, and 700 as they cut a rock sample at a depth of cut (DOC) of 0.1 inches at a 20 degrees back rake angle. As shown, the cutting element 700 having a ridge geometry with a peak first width 725*a* of about 0.1 inches and a roof angle of about 140 degrees has the lowest cutting force, the lowest vertical force, and the lowest specific energy when compared with the other cutting elements 771, 772, and 773 in the same rock-cutting movement. Such results indicate that the ridge geometry shown in FIGS. 25-28 may use less drilling effort and provide better cutting efficiency when compared with other cutting element geometries.

In addition to cutting element geometry that provides improved cutting efficiency by lowering forces during rock fracturing, embodiments of the present disclosure may also include cutting element geometry that aids in rock chip removal. For example, FIGS. 30-34 show a cutting element 800 having a top surface 810 ridge geometry according to embodiments of the present disclosure that includes at least one scooped feature for directing rock chips or other cutting debris away from the cutting tips of the ridge 820.

The ridge geometry of the top surface 810 includes a ridge 820 extending a length 880 across an entire major dimension (e.g., diameter) of the cutting element between opposite edges 814 of the top surface 810, where the ridge geometry varies along its length 880. For example, edge portions 821 of the ridge 820 (e.g., portions of the ridge 820 extending a length 881 radially from the opposite edges 814 of the cutting element) may have a different geometry than the central portion 823 of the ridge 820 (the portion surrounding the longitudinal axis 801 of the cutting element). In the embodiment shown, the width 825 of the ridge 820 may be smaller in the edge portions 821 of the ridge 820 than in the central portion 823 of the top surface 810.

Similar to the embodiment shown in FIGS. 25-28, the ridge peak 822 may have a planar surface lying along a plane perpendicular to the longitudinal axis 801 of the cutting element, where the planar surface peak 822 may form a raised geometric surface relative to recessed edge portions 815. The geometric surface of the peak 822 may have a geometry defined between opposite lateral sides of the peak 822 and between opposite sides of the edge 814.

Figure 34:
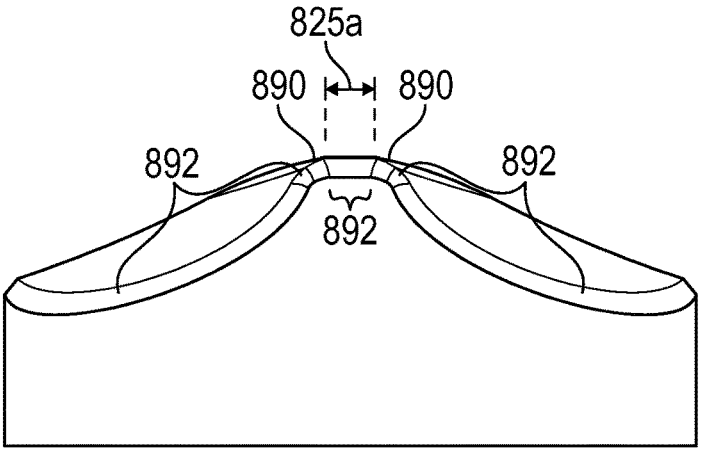

The width 825 of the peak 822 may measured between opposite sides of the peak 822 planar surface. The width 825 of the peak 822 may increase from a first width 825*a* proximate the edge 814 of the cutting element to a second width 825*b* in the central portion 823 of the top surface 810. As shown in FIG. 34, two cutting tips 890 may be formed at the cutting element edge 814 on opposite sides of the peak 822 at the first width 825*a*, and three cutting edges 892 may be alternatingly formed around the cutting tips 890. The alternating cutting tips 890 and cutting edges 892 may contact and fracture rock during cutting.

Further, the top surface geometry may include undulating sidewalls 830 formed on opposite sides of the ridge 820. The undulating sidewalls 830 may include scooped regions 831 positioned proximate to and on opposite sides of the peak 822 in the edge portions 821. The scooped regions 831 may have a generally concave geometry and extend between the transition region 835*a*, cutting edges 892, and a recessed edge portion 815 of the edge 814. The scooped regions 831 may provide a path for the flow of rock debris around the peak 820 and away from the cutting element. The undulating sidewalls 830 may further include raised regions 832 positioned between the scooped regions 831 on opposite sides of the peak 822 and extending from the transition region 835*b* to a raised edge portion 816 of the edge 814. In such manner, the edge 814 formed around the cutting element may undulate in height between the ridge peak 822, the recessed edge portions 815, and the raised edge portions 816.

The ridge geometry may further include a transition region 835*a*, 835*b* (collectively referred to as 835) providing a curved transition between the ridge peak 822 and undulating sidewalls 830 positioned on opposite sides of the peak 822. The transition region 835 may have a varying geometry along the length 880 of the ridge 820 and corresponding with at least one of the geometry of the undulating sidewalls 830 and the varying ridge width 825. In the embodiment shown in FIGS. 30-34, first transition regions 835*a* on opposite sides of the peak 822 in the edge portions 821 of the ridge 820 may have a smaller size than a second transition region 835*b* in the central portion 823 of the top surface 810. For example, the first transition regions 835*a* may have a relatively tighter curvature from the peak 822 to the scooped regions 831 in the undulating sidewalls 830 compared to the second transition region 835*b* having a relatively larger curvature from the peak 822 to the raised regions 832 of the undulating sidewalls 830. Additionally, the first transition regions 835*a* may have a relatively smaller width, as measured laterally from the peak 822, compared to the second transition region 835*b* having a relatively larger width, as measured laterally from the peak 822.

Cutting elements according to embodiments of the present disclosure may be formed, for example, by forming an ultrahard layer having ridge geometry disclosed herein using a mold with a negative of the ridge geometry. The ultrahard layer having ridge geometry according to embodiments of the preset disclosure may be formed on a substrate (e.g., placing ultrahard material such as diamond powder adjacent to a preformed substrate or substrate material in a high pressure high temperature press and sintering the material together) or may be pre-formed and attached to a substrate.

In some embodiments, a method of forming a cutting element with ridge geometry according to embodiments disclosed herein may include providing a cutting element having a ridge formed at a top surface of the cutting element, where the ridge may extend along a major dimension of the top surface from an edge of the top surface and has a peak with a first roof radius of curvature and sidewalls sloping away from the peak at a first roof angle. An amount of ultrahard material from the top surface around an edge portion of the ridge may then be removed to form a second peak having a second roof radius of curvature smaller than the first roof radius of curvature and recessed sidewalls sloping away from the second peak at a second roof angle smaller than the first roof angle. The edge portion having the second roof radius of curvature and the second roof angle may extend a partial length of the ridge from the edge toward a longitudinal axis of the cutting element. For example, in some embodiments, an amount of ultrahard material may be removed from the top surface using a laser to form an edge portion of a ridge having a reduced roof radius of curvature and reduced roof angle (and in some embodiments also a roof ridge angle).

Substrates according to embodiments of the present disclosure may be formed of cemented carbides, such as tungsten carbide, titanium carbide, chromium carbide, niobium carbide, tantalum carbide, vanadium carbide, or combinations thereof cemented with iron, nickel, cobalt, or alloys thereof. For example, a substrate may be formed of cobalt-cemented tungsten carbide. Ultrahard layers according to embodiments of the present disclosure may be formed of, for example, polycrystalline diamond, such as formed of diamond crystals bonded together by a metal catalyst such as cobalt or other Group VIII metals under sufficiently high pressure and high temperatures (sintering under HPHT conditions), thermally stable polycrystalline diamond (polycrystalline diamond having at least some or substantially all of the catalyst material removed), or cubic boron nitride. Further, it is also within the scope of the present disclosure that the ultrahard layer may be formed from one or more layers, which may have a gradient or stepped transition of diamond content therein. In such embodiments, one or more transition layers (as well as the other layer) may include metal carbide particles therein. Further, when such transition layers are used, the combined transition layers and outer layer may collectively be referred to as the ultrahard layer, as that term has been used in the present application. That is, the interface surface on which the ultrahard layer (or plurality of layers including an ultrahard material) may be formed is that of the cemented carbide substrate.

Cutting elements having a ridge geometry according to embodiments of the present disclosure may have improved cutting efficiency. For example, cutting efficiency may be improved due to decreased contacting area between an edge portion of a ridge and a working surface. The inventors of this application have found that cutting element workload grows with the expanding engagement with the rock formation. This engagement is a function of the contacting area as well as the depth of cutting (DOC).

Figure 35:
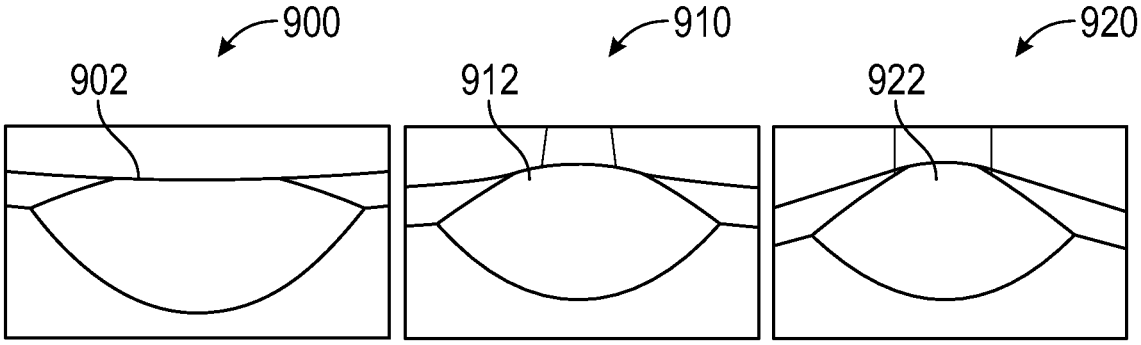
FIG. 35 shows a comparison between the contacting area of a planar cutting element with ridge cutting elements at a depth of cut.
Figure 36:
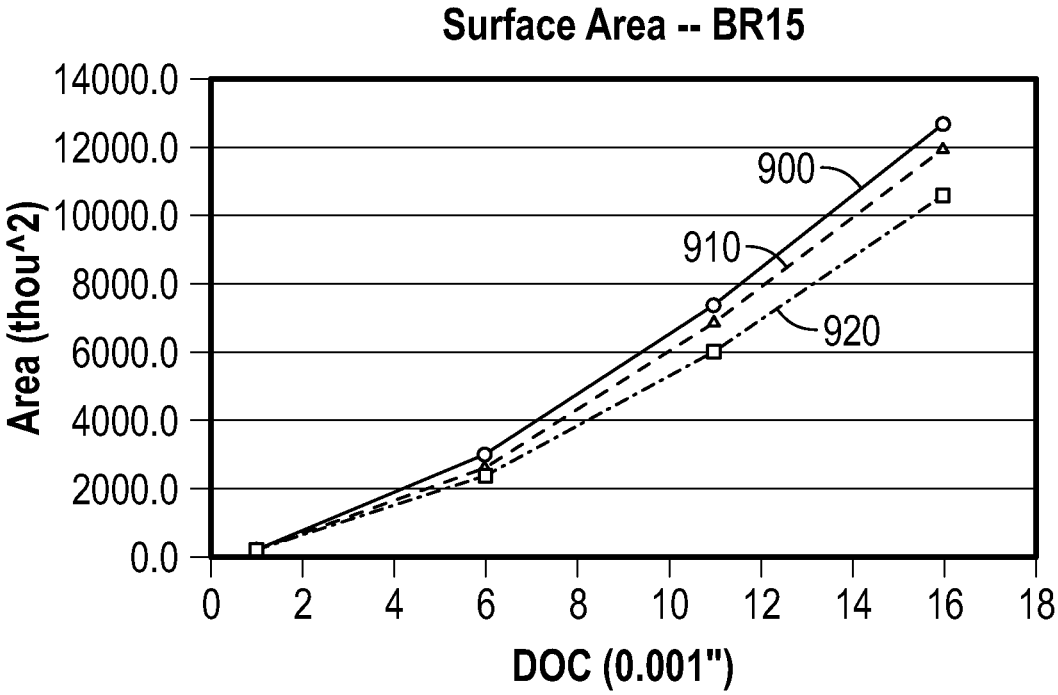
FIG. 36 shows a graph of the change in contacting area at different depths of cut for the cutting elements shown in FIG. 35.

Referring to FIGS. 35 and 36, a study on the performance of ridge geometry according to embodiments of the present disclosure is shown. In the study, three models of cutting elements, including a conventional cutting element 900 having a planar top surface, a first ridge cutting element 910 having a roof angle of 159 degrees, and a second ridge cutting element 920 having a roof angle of 135 degrees, were built for the geometric study and contacted to a working surface at different DOCs. The highlighted portions of the cutting elements 900, 910, 920 show the contacting area 902, 912, 922. FIG. 36 shows a graph of the growth of the contacting area of each sample cutting element 902, 912, 922 with the increasing DOC at a constant back-rake angle of 15 degrees. From the study, it was evident that the growth rate varied with the roof angle, where the greater the roof angle, the faster the contacting area 902, 912, 922 enlarges with the increasing DOC.

Further, contacting area correlates to the penetrating resistance when a cutting element cuts into a rock formation. Therefore, combining various roof angles, e.g., forming an edge portion of a ridge with a smaller roof angle compared with a central portion of the ridge, as described herein, may be used to control the contacting area of the cutting element. When a relatively larger roof angle is formed in the central portion of the ridge, the cutting element may be limited on the amount of penetration at the transition between the smaller roof angle portion (in the edge portion of the ridge) and the larger roof angle portion (in the central portion of the ridge). In such manner, the contacting area of a cutting element may be controlled (and thus reduce effects of overloading the cutting element) by designing a selected edge portion of a ridge to have a reduced roof angle relative to a larger roof angle in a central portion of the ridge.

Further, embodiments of the present disclosure may have an edge portion of a ridge having a reduced peak width relative to the peak width of an adjacent central portion of the ridge. By increasing the width of the ridge peak in a central portion of the ridge relative to an edge portion of the ridge, crack propagation may be reduced. For example, if a crack initiates from an edge of a ridge cutting element according to embodiments of the present disclosure, the crack may propagate until meeting an increased amount of ultrahard material at the relatively wider central portion of the ridge, at which point, the relatively wider central portion of the ridge may inhibit further crack growth.

While ridge cutting elements having a generally uniform ridge geometry along the entire length of the ridge may have better drilling efficiency when compared with, for example, a conventional planar cutting element, such ridge geometry may suffer from increased loads in operation, and thus experience premature failures (most commonly ultrahard material layer fracturing. By modifying an edge portion of the ridge in accordance with embodiments disclosed herein, the loading may be controlled, and thus improve the life of the cutting element.

Figure 37:
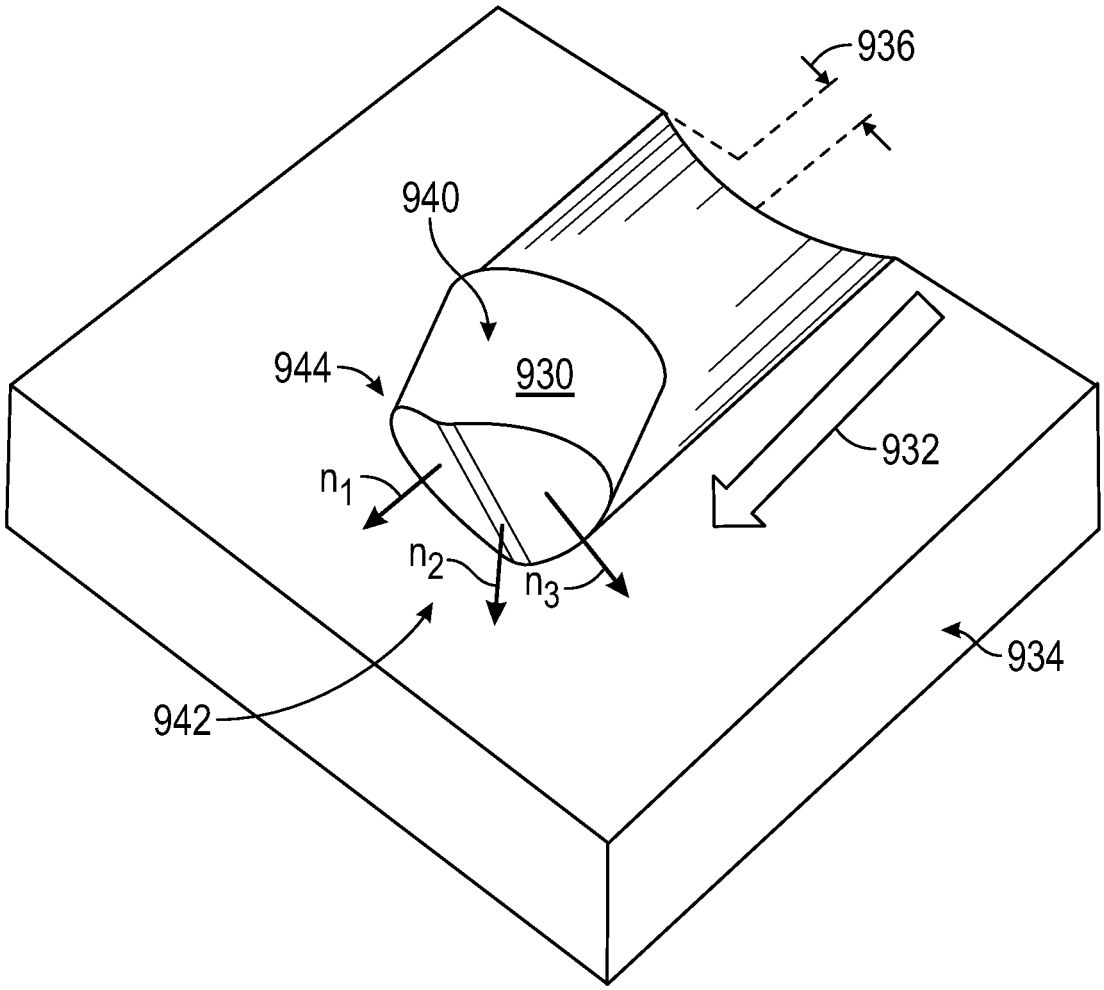
FIG. 37 shows a schematic of forces acting on a ridge cutting element.

In another study, cutting elements having a generally uniform ridge geometry along the entire length of the ridge with a roof angle of 175 degrees in a blunter ridge cutting element and with a roof angle of 135 degrees in a sharper ridge cutting element were compared using rock cutting tests on a vertical turret lathe. FIG. 37 shows a representation of the ridge cutting elements 930 moving in direction 932 on a rock sample 934 in the vertical turret lathe test. Three forces acting on the ridge cutting elements 930, including vertical force 940, cutting force 942, and side force 944, were recorded during testing. From the test results, it was found that the sharper ridge cutting element with the roof angle of 135 degrees required only half of the vertical force applied on the blunter ridge cutting element with 175 degrees to reach the same depth of cutting 936. It was also found that the sharper ridge cutting element (with 135-degree roof angle) took about 60% of the cutting force applied on the blunter ridge cutting element (with 175-degree roof angle) to drag the ridge cutting element forward.

Figure 38:
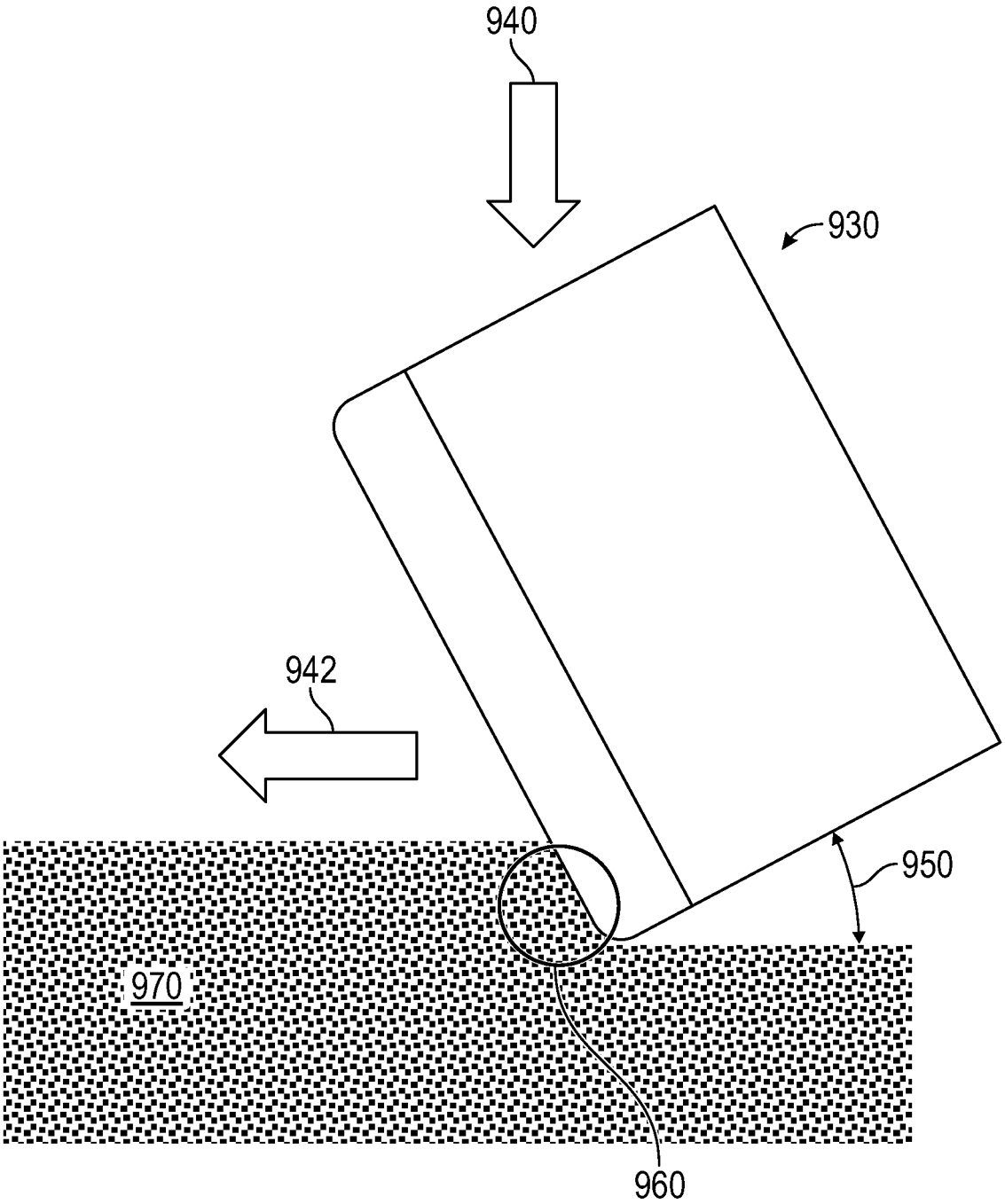
FIG. 38 shows a cross-sectional view of a ridge cutting element as it cuts a formation.

The ridge cutting elements 930 were further equipped on bits with back-rake angles 950 between 12 and 20 degrees, as shown in FIG. 38. In addition, the ridge cutting elements 930 included a roof ridge angle of around 5 degrees, which increased the effective back-rake angle 950. In drilling, this back-rake angle 950 resulted in compression 960 on the ahead rock 970 (i.e., the rock directly ahead of the cutting element when cutting) from the vertical force 940 and the cutting force 942. Such compression 960 may restrict the rock 970 fracturing and removal. Thus, a lower back-rake angle 950 may reduce such resistance to rock fracturing. Ridge cutting elements according to embodiments of the present disclosure having a reduced roof angle and reduced roof radius of curvature (either with or without a roof ridge angle) were shown to have noticeably reduced compression in the ahead rock 970 during testing. In addition, the ridge cutting element having a modified edge portion tended to break the fractured rocks into smaller pieces.

According to embodiments of the present disclosure, an edge portion of a ridge cutting element may be modified to have a reduced roof angle (e.g., 125 degrees or less) and a reduced roof radius of curvature (e.g., less than 0.11 inches). The smaller roof radius of curvature may smooth the sharper angle from the reduced roof angle.

Further, one or more concave recesses (e.g., a tear-drop shaped dimple) may be introduced on the peak of the ridge for reduced compression on ahead rock and the ease of rock chip breakdown. A concave recess may be employed on the ridge peak between an edge portion and central portion of the ridge (e.g., on a portion of the ridge sloping at a roof ridge angle) to bridge the modified edge portion and the remaining portion of the ridge.

The cutting efficiency of a ridge cutting element having a modified edge portion with a reduced roof angle and reduced roof radius of curvature according to embodiments of the present disclosure was estimated by finite element analysis (FEA) modeling. In comparison to a ridge cutting element having a generally uniform ridge geometry, a ridge cutting element having a modified edge portion with a roof angle of 120 degrees and roof radius of curvature of less than 0.11 inches required 10 percent less cutting force. By reducing the cutting force, the bit-turning resistance may also be reduced, thereby improving bit responses to drive changes.

Embodiments of a shaped element have been primarily described with reference to wellbore drilling operations; the shaped elements described herein may be used in applications other than the drilling of a wellbore. In other embodiments, shaped elements according to the present disclosure may be used outside a wellbore or other downhole environment used for the exploration or production of natural resources. For instance, shaped elements of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. Changes that come within the meaning and range of equivalency of the claims are to be embraced within their scope.

What is claimed is:

1. A cutting element comprising:

a substrate; and an ultrahard layer on an upper surface of the substrate, a top surface of the ultrahard layer comprising:

a ridge extending along a major dimension of the top surface from an edge of the top surface, the ridge having a peak with at least two different roof radii of curvature; and at least two sidewalls sloping in opposite directions from the peak of the ridge at a roof angle, wherein a first roof angle of the ridge proximate the edge is smaller than a second roof angle in a central portion of the ridge around a longitudinal axis of the cutting element.

2. The cutting element of claim 1, wherein a roof ridge angle defined between a line tangent to the peak of the ridge proximate the edge and a plane perpendicular to the longitudinal axis ranges from greater than zero to 10 degrees.

3. The cutting element of claim 1, wherein the sidewalls sloping from the ridge at the first roof angle are recessed from the sidewalls sloping from the ridge at the second roof angle.

4. The cutting element of claim 1, further comprising a chamfer formed around the edge of the top surface.

5. The cutting element of claim 1, wherein the ridge has at least one concave recess formed along the peak of the ridge.

6. The cutting element of claim 1, wherein an interface formed between a bottom surface of the ultrahard layer and the upper surface of the substrate is nonplanar, the bottom surface comprising a protrusion formed opposite the ridge and proximate the edge and the upper surface of the substrate comprising a recessed portion having a corresponding shape to the protrusion.

7. The cutting element of claim 1, wherein the first roof angle ranges between 110 degrees and 130 degrees, and the second roof angle ranges between 135 degrees and 165 degrees.

8. A cutting element comprising:

a top surface having a ridge extending from an edge of the top surface along a major dimension of the top surface; and a peak of the ridge having a width measured between opposite points of transition from the peak to a sidewall, wherein the width of the peak in a central portion of the ridge around a longitudinal axis of the cutting element is greater than the width of the peak at the edge portion of the ridge, the edge portion extending a length of the ridge from the edge to the central portion, wherein the peak has a roof radius of curvature along an edge portion of the ridge less than 0.1 inches.

9. The cutting element of claim 8, wherein the peak in the central portion of the ridge has a polygonal shape.

10. The cutting element of claim 8, wherein the peak in the central portion of the ridge has an oval shape.

11. The cutting element of claim 8, wherein the width of the peak in the central portion of the ridge extends greater than 50 percent of the major dimension.

12. The cutting element of claim 8, wherein the width of the peak in the central portion of the ridge extends to opposite sides of the edge of the top surface.

13. The cutting element of claim 8, wherein the sidewalls on opposite sides of the peak in the edge portion extend from the peak at a roof angle less than 135 degrees.

14. The cutting element of claim 8, wherein the peak of the edge portion extends from the central portion at a roof ridge angle defined between a line tangent to the peak of the ridge and a plane perpendicular to the longitudinal axis ranges from greater than zero to 10 degrees.

15. A cutting element, comprising:

a substrate; and an ultrahard layer on an upper surface of the substrate, a top surface of the ultrahard layer comprising:

a ridge extending across a major dimension of the top surface between opposite sides of an edge around the top surface, wherein the ridge comprises:

a peak, wherein at least a portion of the peak is formed of a planar surface; and a width measured between opposite sides of the peak;

wherein the width of the ridge in an edge portion of the ridge is smaller than the width of the ridge in a central portion of the top surface; and sidewalls extending from opposite sides of the ridge to at least one recessed edge portion of the edge.

16. The cutting element of claim 15, wherein the portion of the peak having a planar surface forms a geometric surface extending between opposite sides of the edge.

17. The cutting element of claim 15, wherein the peak in the edge portion of the ridge has a roof radius of curvature that is less than 0.1 inches.

18. The cutting element of claim 15, wherein the sidewalls have an undulating geometry comprising at least one scooped region proximate a cutting edge portion of the edge and at least one raised region extending between the central portion and a raised edge portion of the edge.

19. The cutting element of claim 15, wherein the top surface further comprises a transition region extending between the peak and the sidewalls.

* * * * *